US005735458A

United States Patent [19]

Brown et al.

[11] Patent Number: 5,735,458

[45] Date of Patent: Apr. 7, 1998

[54] FASTENING RAILWAY RAILS

[75] Inventors: Trevor P. Brown, Petts Wood; Brian G. Conroy, Crabtree Park; Stephen J. Cox, Richmond; Christopher Gardner, Sheffield; Roger D. Larke, Retford; Barry Marshall, Sheffield, all of United Kingdom; Jan Svendsen, Tranby, Norway

[73] Assignee: Pandrol Limited, Surrey, United Kingdom

[21] Appl. No.: 705,672

[22] Filed: Aug. 30, 1996

Related U.S. Application Data

[60] Continuation-in-part of Ser. No. 474,181, Jun. 7, 1995, abandoned, which is a division of Ser. No. 244,716, filed as PCT/GB92/02357, Dec. 18, 1992, abandoned.

[30] Foreign Application Priority Data

Dec. 18, 1991 [GB] United Kingdom ..... 9126886
Mar. 17, 1992 [GB] United Kingdom ..... 9205791

[51] Int. Cl.[6] ..... E01B 9/00

[52] U.S. Cl. ..... 238/343; 238/345; 238/349; 238/351

[58] Field of Search ..... 238/310, 315, 238/338, 343, 349, 351

[56] References Cited

U.S. PATENT DOCUMENTS 2,162,365 6/1939 Willard .
2,570,871 10/1951 Schulze .
2,844,326 7/1958 Van Der Weyden .
2,954,169 9/1960 Rigby ..... 238/349
3,428,253 2/1969 Meier .

(List continued on next page.)

FOREIGN PATENT DOCUMENTS 55027 11/1970 Australia .
0024774 3/1981 European Pat. Off. .
0027838 5/1981 European Pat. Off. .
0027839 5/1981 European Pat. Off. .
0156349 10/1985 European Pat. Off. .

(List continued on next page.)

OTHER PUBLICATIONS

German Language Abstract of 89.08.435 / Oct. 12, 1989.

*Primary Examiner*—Mark T. Le
*Attorney, Agent, or Firm*—Depaoli & Frenkel, P.C.

[57] ABSTRACT

A railway rail anchoring device, for use with a railway rail-fastening clip which is approximately M-shaped in plan and has first and second leg portions and a rail-bearing portion, comprises a base member and first and second clip-retaining members connected together by the base member such that the first clip-retaining member is spaced apart from the second clip-retaining member so as to define between the first and second clip-retaining members an opening for receiving the rail-bearing portion of such a clip. Each of the first and second clip-retaining members defines a passageway for receiving one of the leg portions of such a clip, and a boundary surface of at least one of the passageways includes, at a location intermediate respective ends of the passageway, first locating part for engagement, when the device is in use with such a clip, with a first region of the leg portion of the clip located in the passageway such that the clip can be held in a pre-assembly position in which the is retained by the device but the rail-bearing portion of the clip does not bear on a rail. Second locating part is also provided on a boundary surface of at least one of the passageways for engagement with a second region of the leg portion of the clip located in the passageway such that the clip can be held in a working position in which the rail-bearing portion of the clip bears on the rail. The first and second locating parts are such that the clip cannot move out of the pre-assembly position towards a rail unless driven in a first direction and the clip cannot move out of the working position away from the rail unless driven in a second direction, opposite to the first direction.

17 Claims, 23 Drawing Sheets

U.S. PATENT DOCUMENTS

Figure 1A:
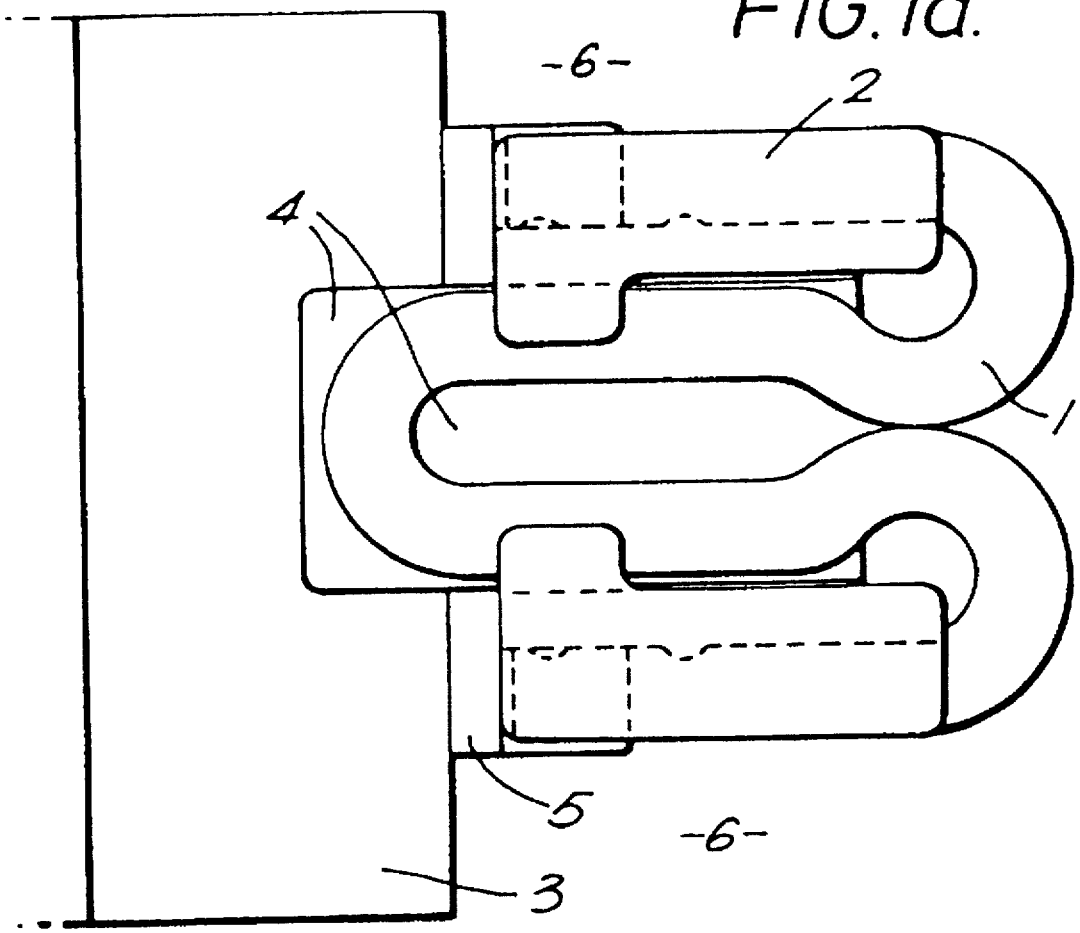

| | | | |
|---|---|---|---|
| 3,439,874 | 4/1969 | Meier . | |
| 3,658,247 | 4/1972 | Serafin et al. . | |
| 3,696,998 | 10/1972 | Bhaskaran Nair . | |
| 3,724,754 | 4/1973 | Molyneux et al. . | |
| 3,876,141 | 4/1975 | French . | |
| 3,970,248 | 7/1976 | Molyneux . | |
| 4,267,970 | 5/1981 | Lubbers | 238/349 |
| 4,278,204 | 7/1981 | Miller . | |
| 4,349,150 | 9/1982 | Lubbers . | |
| 4,632,308 | 12/1986 | Fischer . | |
| 4,802,623 | 2/1989 | Fasterding et al. . | |
| 4,832,261 | 5/1989 | Fee . | |
| 4,844,337 | 7/1989 | Fee . | |
| 5,096,119 | 3/1992 | Schultheiss et al. . | |
| 5,520,330 | 5/1996 | Brown et al. . | |

FOREIGN PATENT DOCUMENTS

| | | | |
|---|---|---|---|
| 0295685 | 1/1988 | European Pat. Off. . | |
| 0401424 | 1/1990 | European Pat. Off. . | |
| 2436848 | 4/1980 | France . | |
| 658902 | 4/1937 | Germany . | |
| 1061810 | 12/1959 | Germany . | |
| 1534074 | 12/1970 | Germany . | |
| 1257817 | 10/1971 | Germany . | |
| 3003867 A1 | 9/1981 | Germany . | |
| 3111876 A1 | 6/1982 | Germany . | |
| 8804426 | 4/1988 | Germany . | |
| 4240347 | 6/1994 | Germany . | |
| 128477 | 8/1932 | Poland . | |
| 513292 | 9/1971 | Switzerland . | |
| 1717682 A1 | 3/1992 | U.S.S.R. . | |
| 861473 | 2/1961 | United Kingdom . | |
| 1510224 | 5/1978 | United Kingdom . | |
| 1553793 | 10/1979 | United Kingdom . | |
| 2070110 | 9/1981 | United Kingdom . | |
| 2075580 | 11/1981 | United Kingdom . | |
| 2085057 | 4/1982 | United Kingdom . | |
| 2106571 | 4/1983 | United Kingdom . | |
| 2152120 | 7/1985 | United Kingdom | 238/351 |
| 2153416 | 8/1985 | United Kingdom . | |
| 2255367 | 11/1992 | United Kingdom . | |
| WO 81/00121 | 1/1981 | WIPO . | |
| WO 82/00669 | 3/1982 | WIPO . | |
| WO 84/04766 | 12/1984 | WIPO . | |
| WO 87/00566 | 1/1987 | WIPO . | |
| WO 90/15192 | 12/1990 | WIPO . | |
| WO 91/0391 | 1/1991 | WIPO . | |
| WO 91/11556 | 8/1991 | WIPO . | |

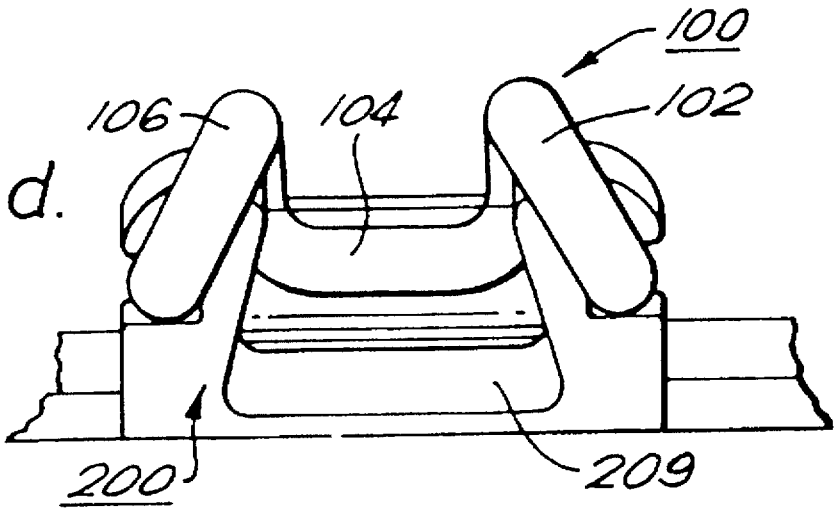
FIG.4d.
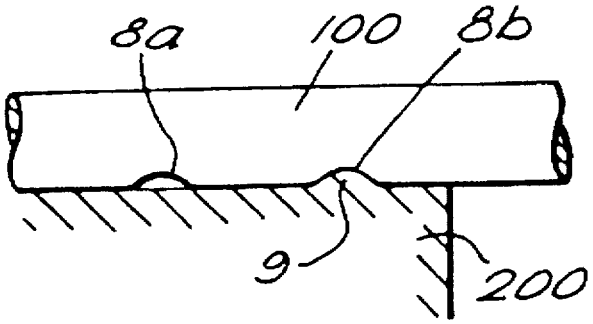
FIG.5a.
FIG.5b.
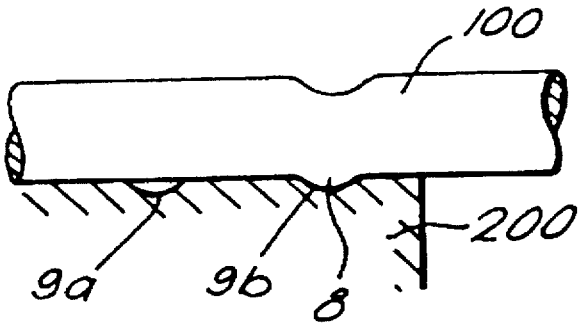
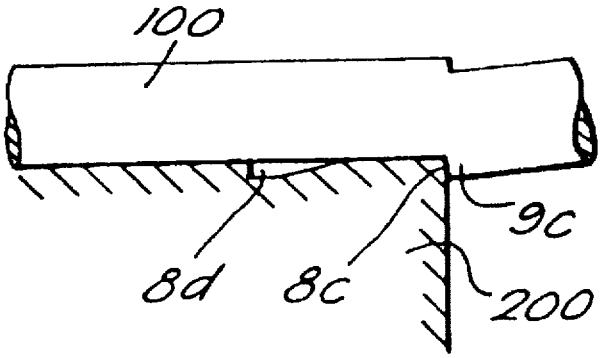
FIG.5c.

-6-

FASTENING RAILWAY RAILS

The present application is a continuation-in-part application of U.S. Ser. No. 08/474,181, filed 7th Jun. 1995 now abandoned, which itself was a divisional application from U.S. Pat. No. 08/244,716 filed as PCT/GB92/02357, Dec. 18, 1992 now abandoned.

The present invention relates to fastening railway rails.

The applicant's previous inventions, rail clips commonly referred to respectively as a "P-R" clip (disclosed in GB-861,473) and an "e"-clip (disclosed in GB-1,510,224), have both been successful for many years, providing low-cost rail fastenings that have been widely used in many countries around the world. These clips may be installed into shoulders alongside the rail either manually, using a sledgehammer to drive the clip into the shoulder, or automatically by a clip driving machine. Whilst automatic clip installation is obviously more desirable, being quicker and less labour-intensive, it can be a fairly complex process, requiring accurate positioning of the clip relative to the shoulder in order to achieve an adequate rail fastening.

According to a first aspect of the present invention there is provided a railway rail anchoring device, for use with a railway rail-fastening clip which is approximately M-shaped in plan and has first and second leg portions and a rail-bearing portion, the device comprising:

a base member; and first and second clip-retaining members connected together by said base member such that the first clip-retaining member is spaced apart from the second clip-retaining member so as to define between said first and second clip-retaining members an opening for receiving the said rail-bearing portion of such a clip;

wherein each of the said first and second clip-retaining members defines a passageway for receiving one of the leg portions of such a clip, a boundary surface of at least one of the said passageways including, at a location intermediate respective ends of said passageway, first locating means for engagement, when the device is in use with such a clip, with a first region of the leg portion of the clip located in said passageway such that the clip can be held in a pre-assembly position in which the clip is retained by the device but the rail-bearing portion of the clip does not bear on a rail, second locating means also being provided on a boundary surface of at least one of the said passageways for engagement with a second region of the leg portion of the clip located in said passageway such that the clip can be held in a working position in which the rail-bearing portion of the clip bears on the rail, the first and second locating means being such that the clip cannot move out of said pre-assembly position towards a rail unless driven in a first direction and the clip cannot move out of said working position away from said rail unless driven in a second direction, opposite to said first direction.

In an embodiment of the present invention, third locating means are provided in the said opening defined between the said first and second clip-retaining members for engagement with a locating region of a toe insulator of such a clip so that the clip can be held in a maintenance position in which the clip does not bear on the rail and the said first region of the leg portion of the clip does not engage with the said first locating means of the device.

The installation of railway track can therefore be facilitated by using anchoring devices embodying the present invention, since prior to laying of the sleepers clips can installed into the anchoring devices in such a way as to be held in those devices in a pre-assembly position which allows unobstructed threading of rails between the anchoring devices. The clips can then be driven into their working positions on the rail, either automatically or manually (both processes being facilitated by pre-insertion of the clips).

Figure 1B:
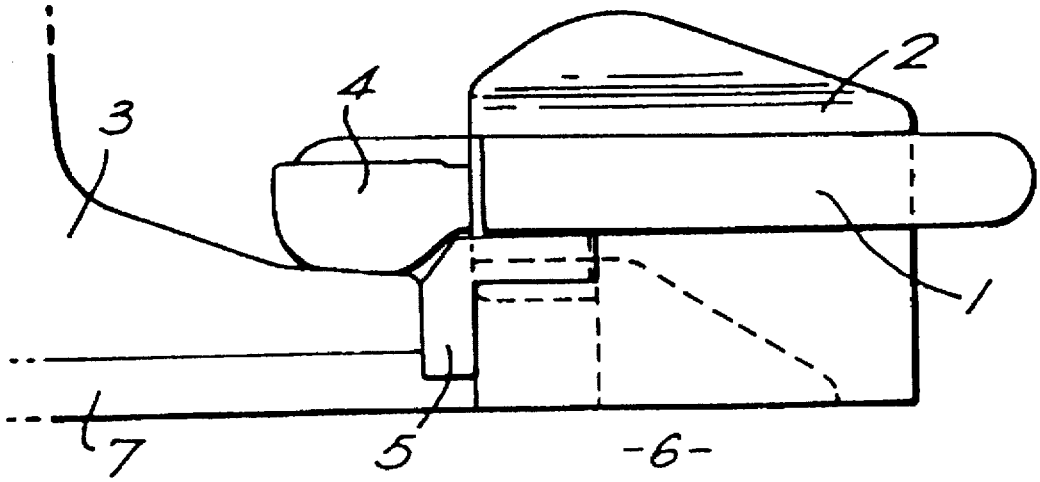
Figure 1C:
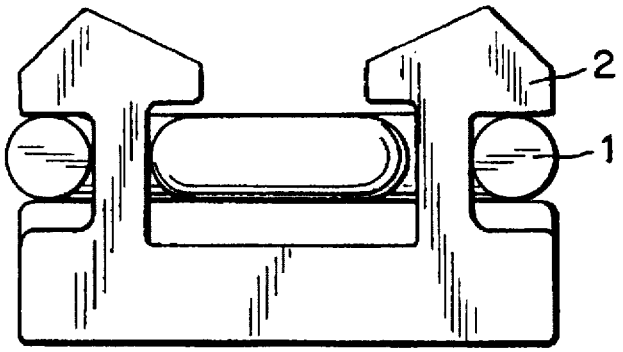
Figure 2A:
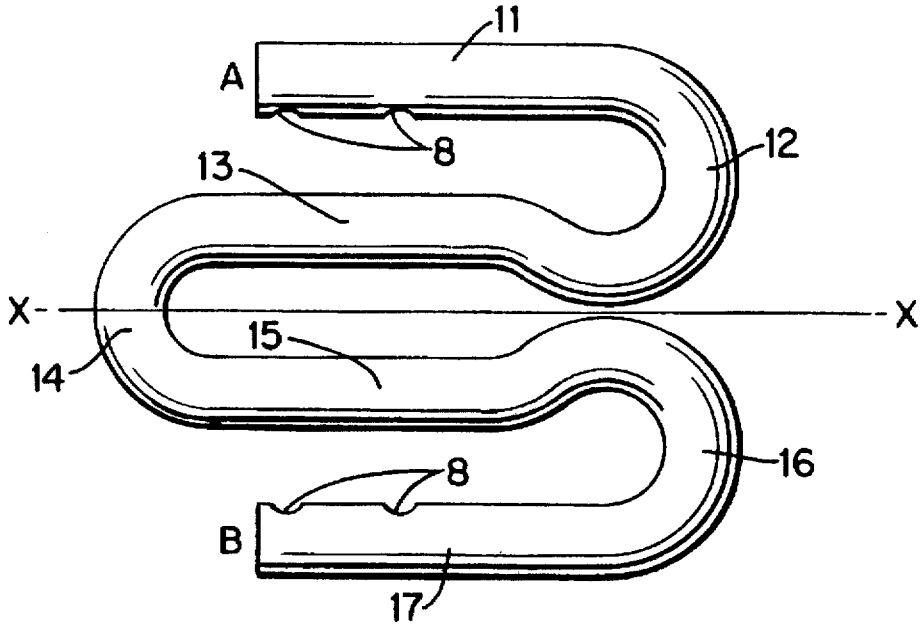
Figure 2B:
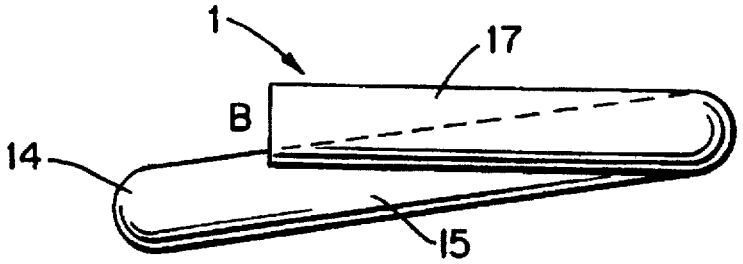
Figure 3A:
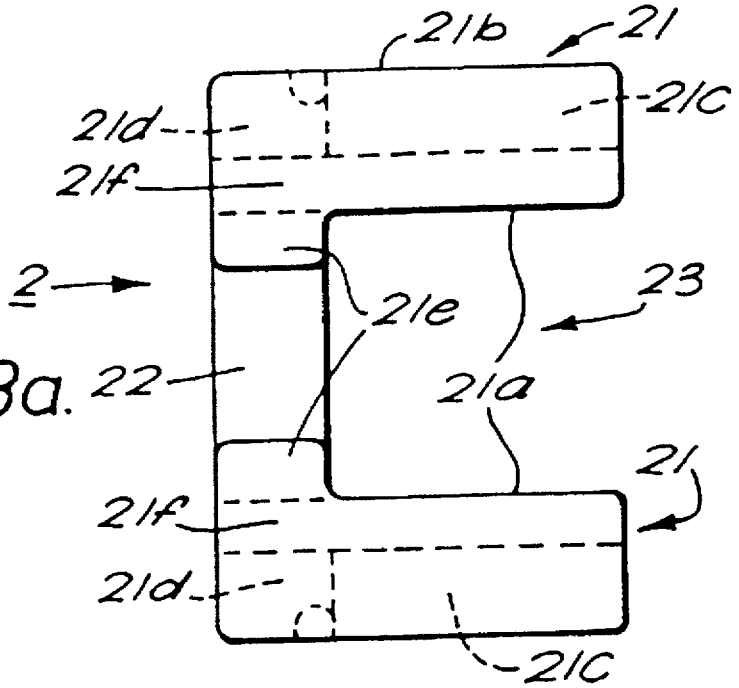
Figure 3B:
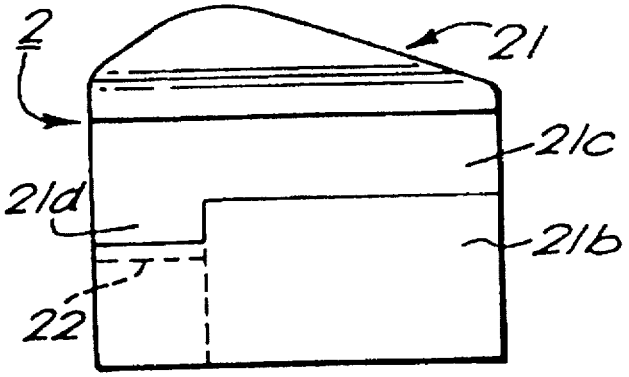
Figure 3C:
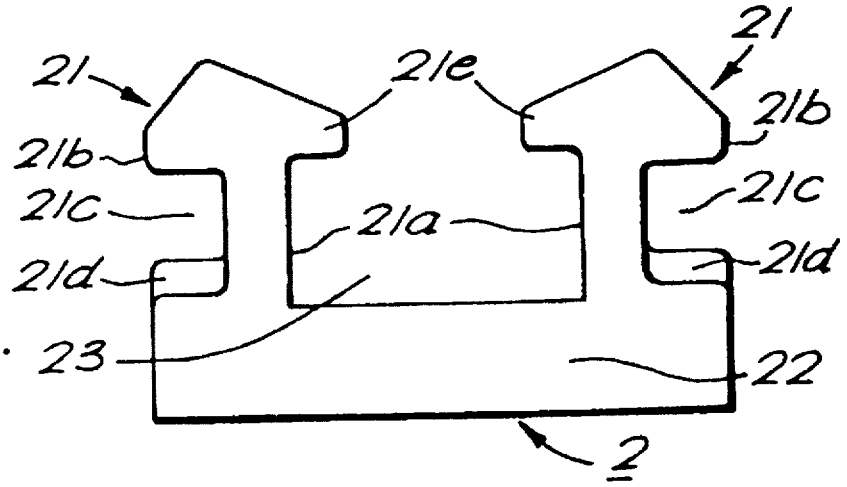
Figure 4A:
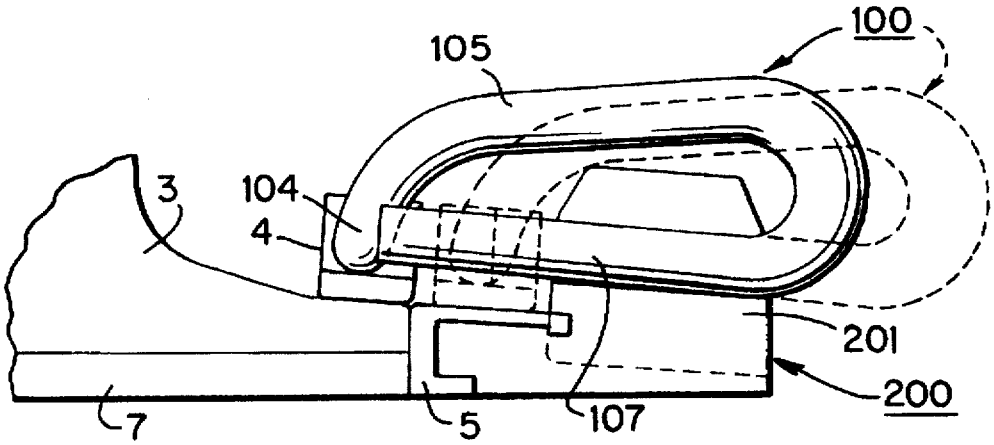
Figure 4B:
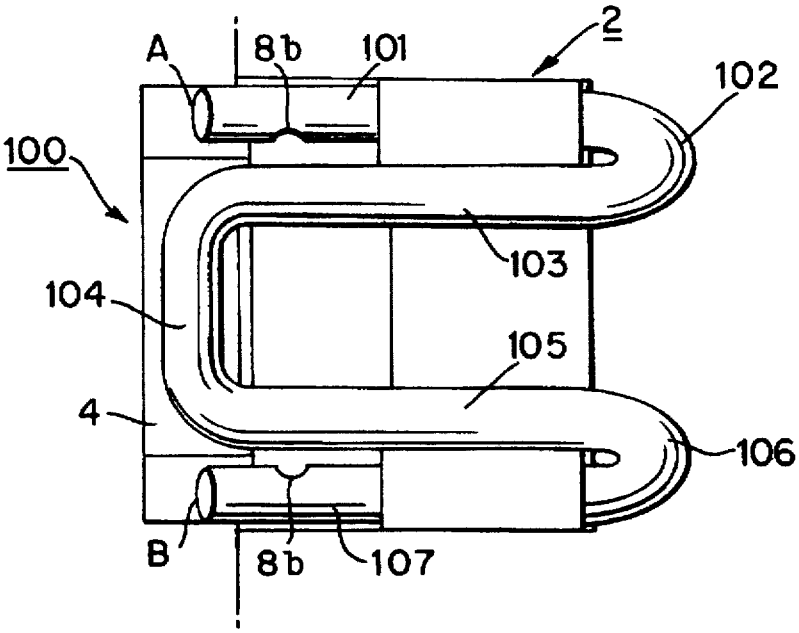
Figure 4C:
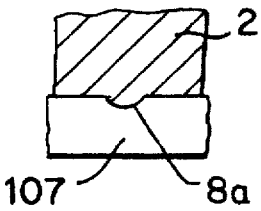
Figure 6:
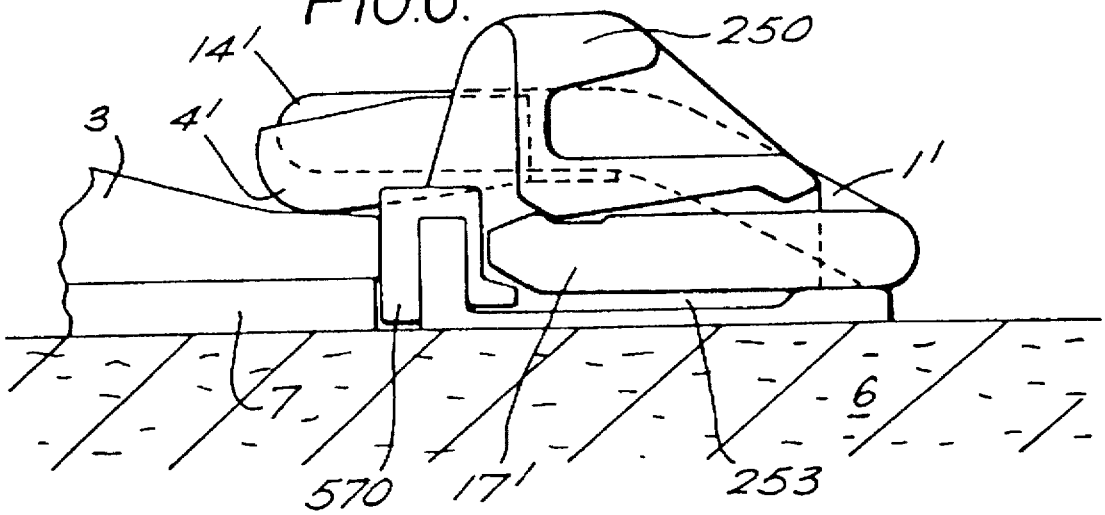
Figure 7A:
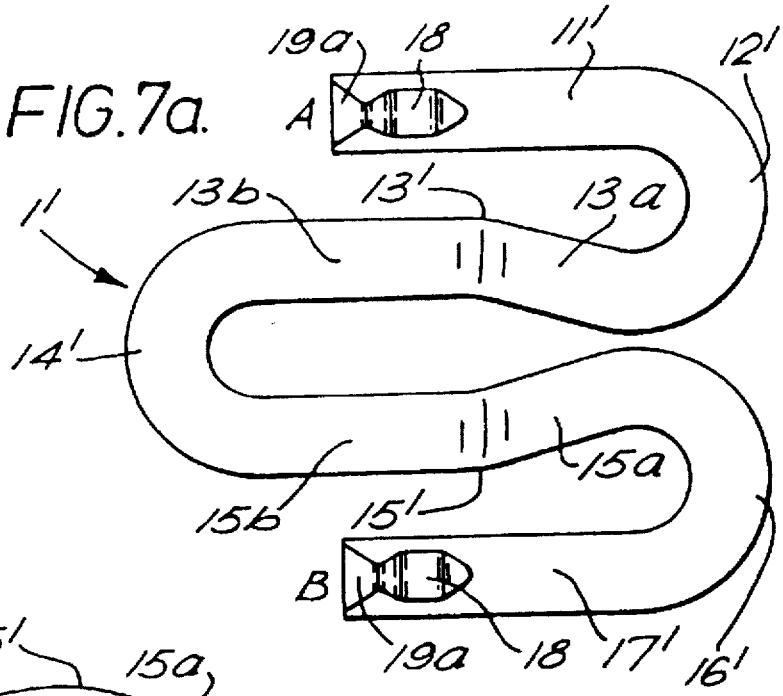
Figure 7B:
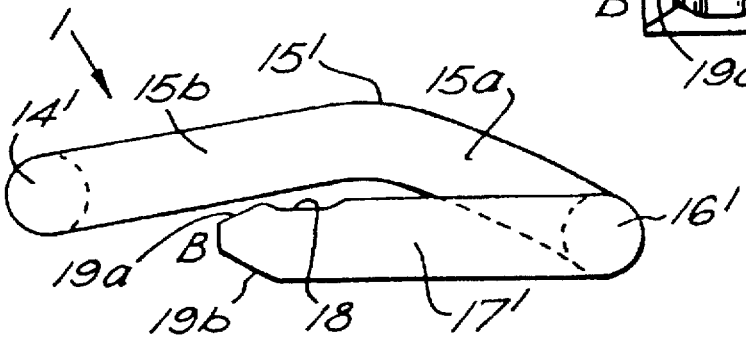
Figure 7C:
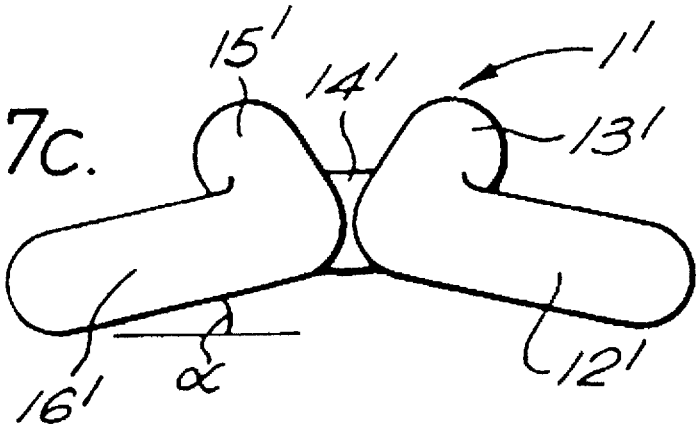
Figure 7D:
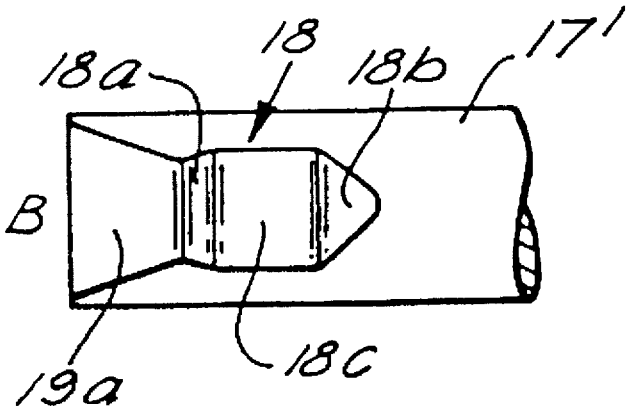
Figure 7E:
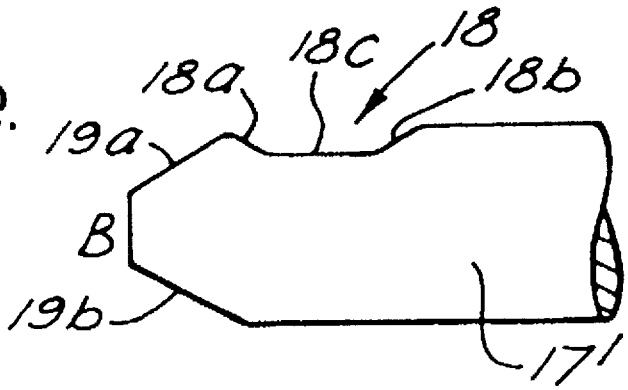
Figure 8A:
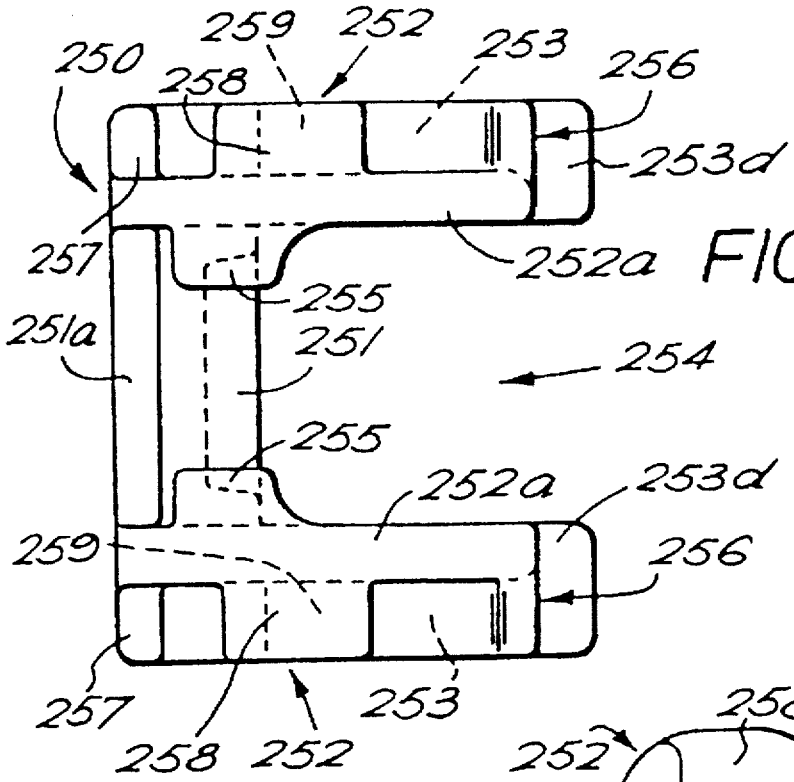
Figure 8B:
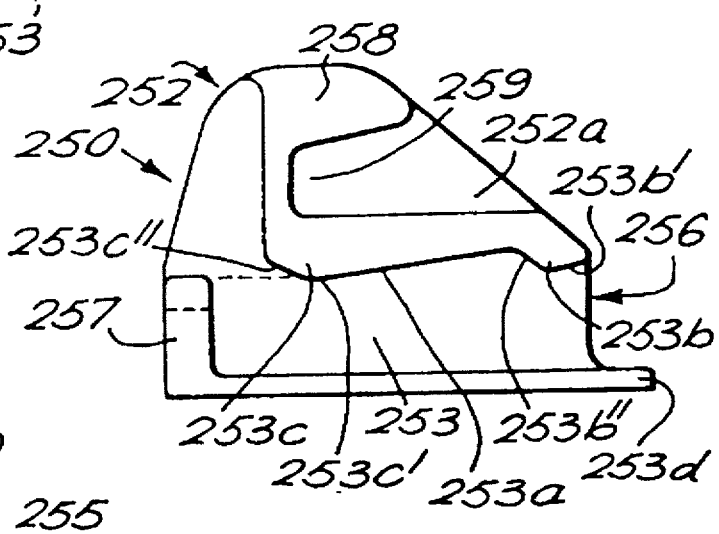
Figure 8C:
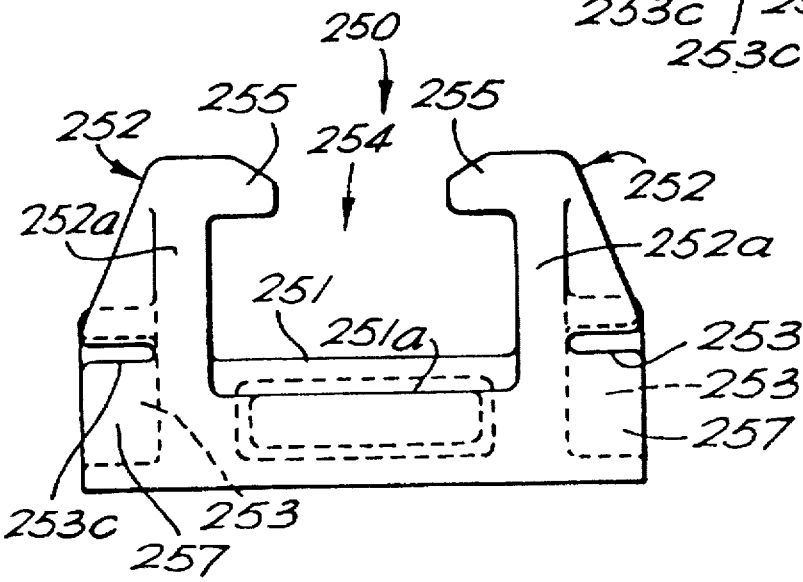
Figure 9A:
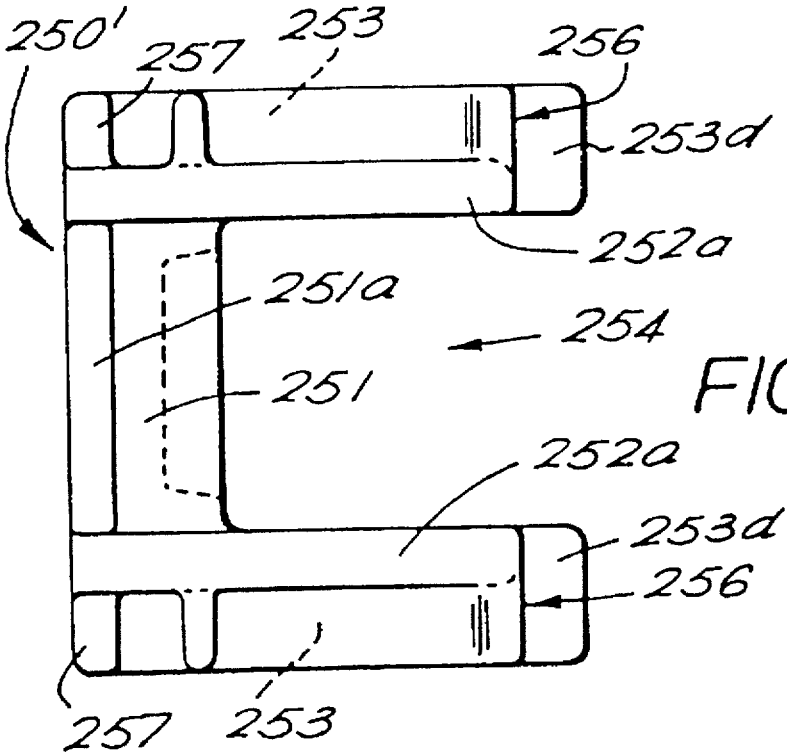
Figure 9B:
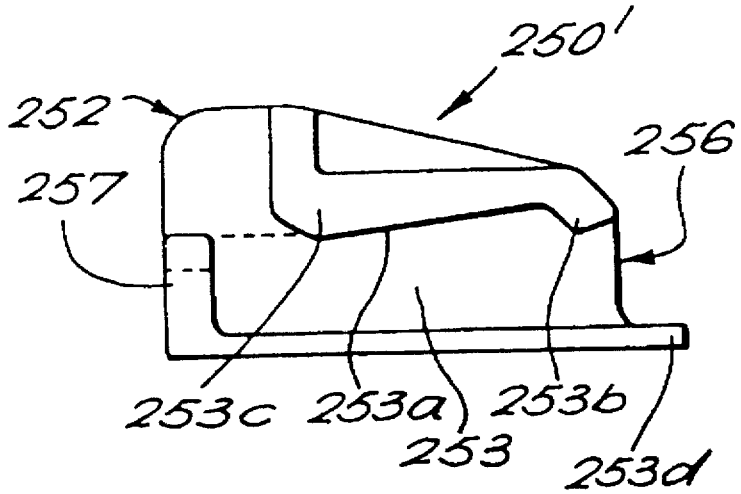
Figure 9C:
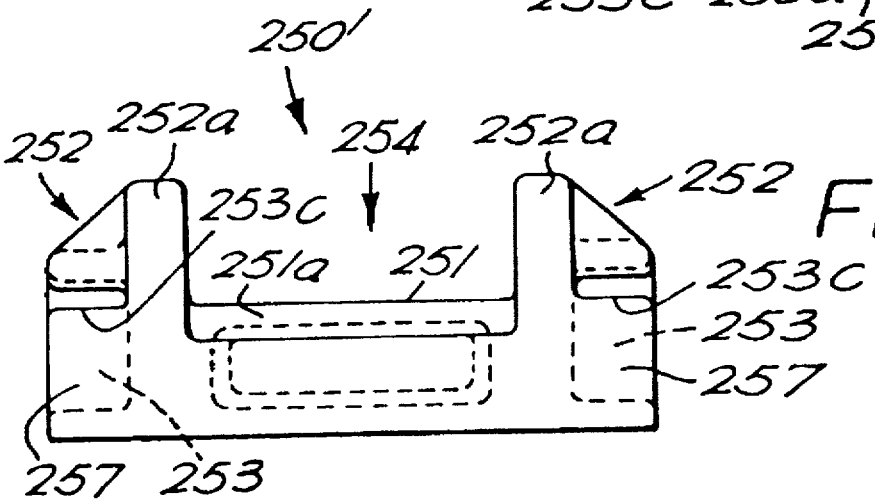
Figure 10A:
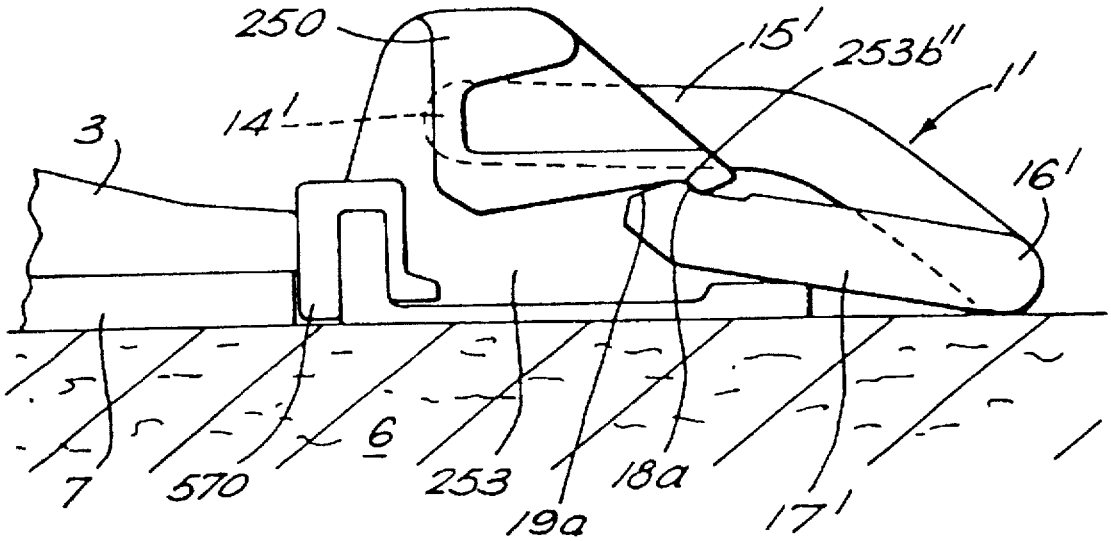
Figure 10B:
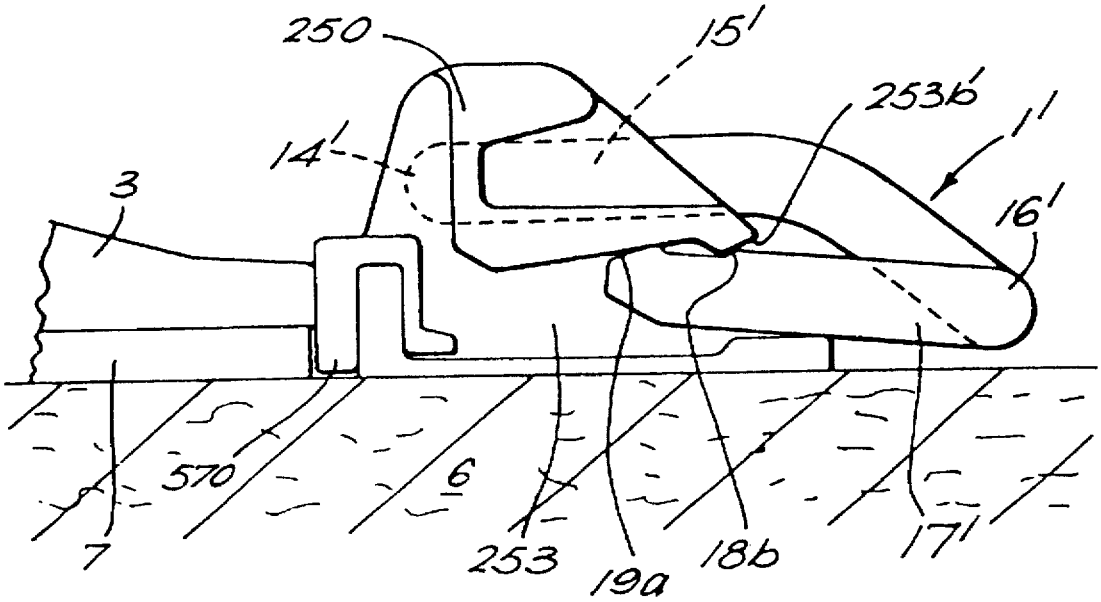
Figure 10C:
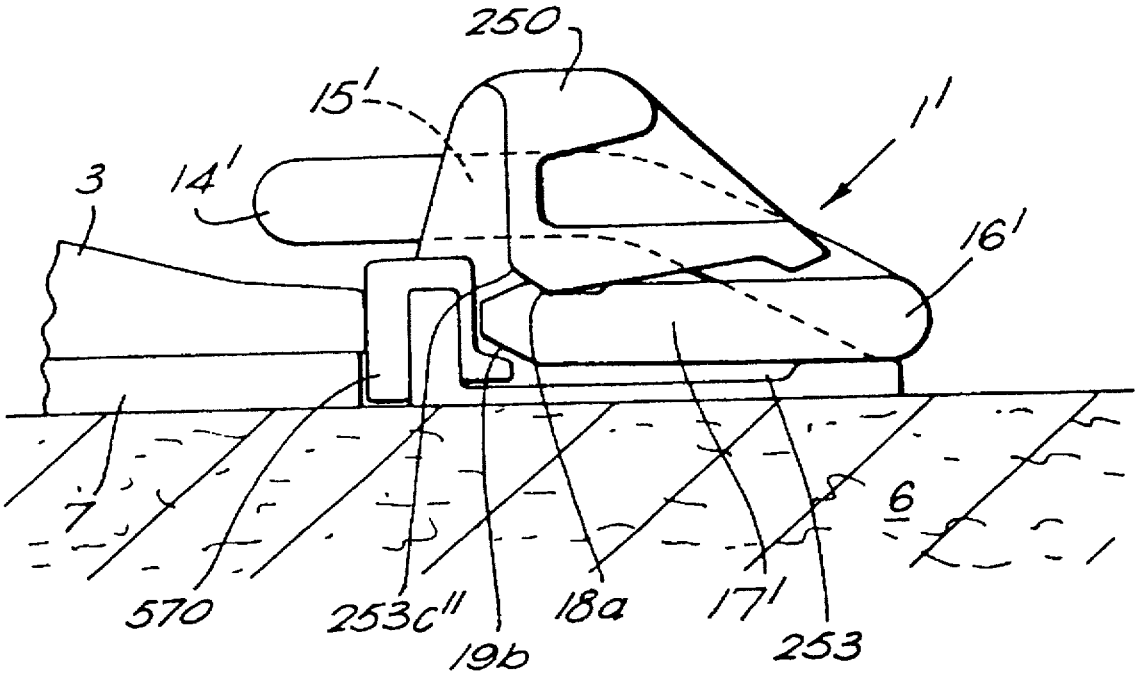
Figure 11A:
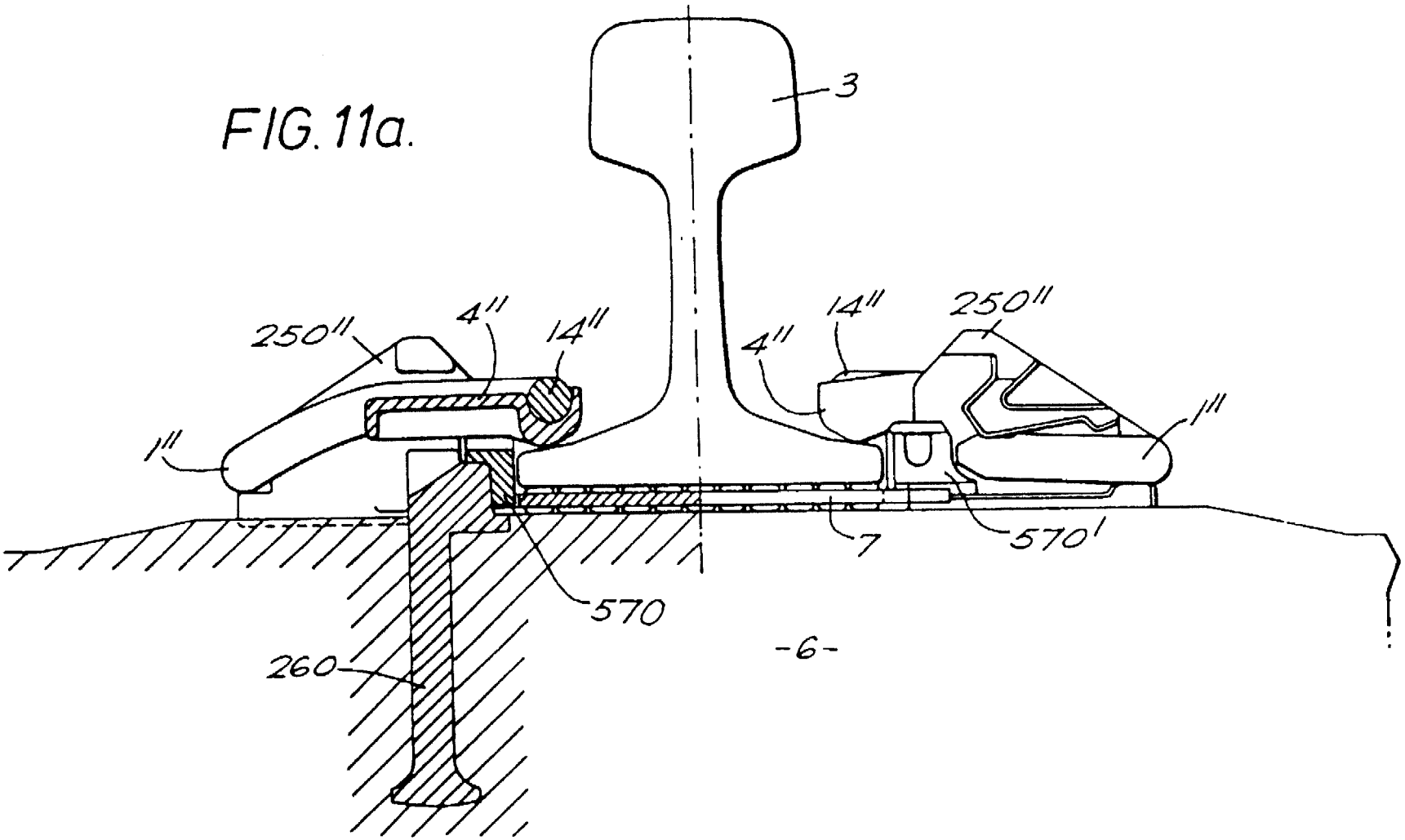
Figure 11B:
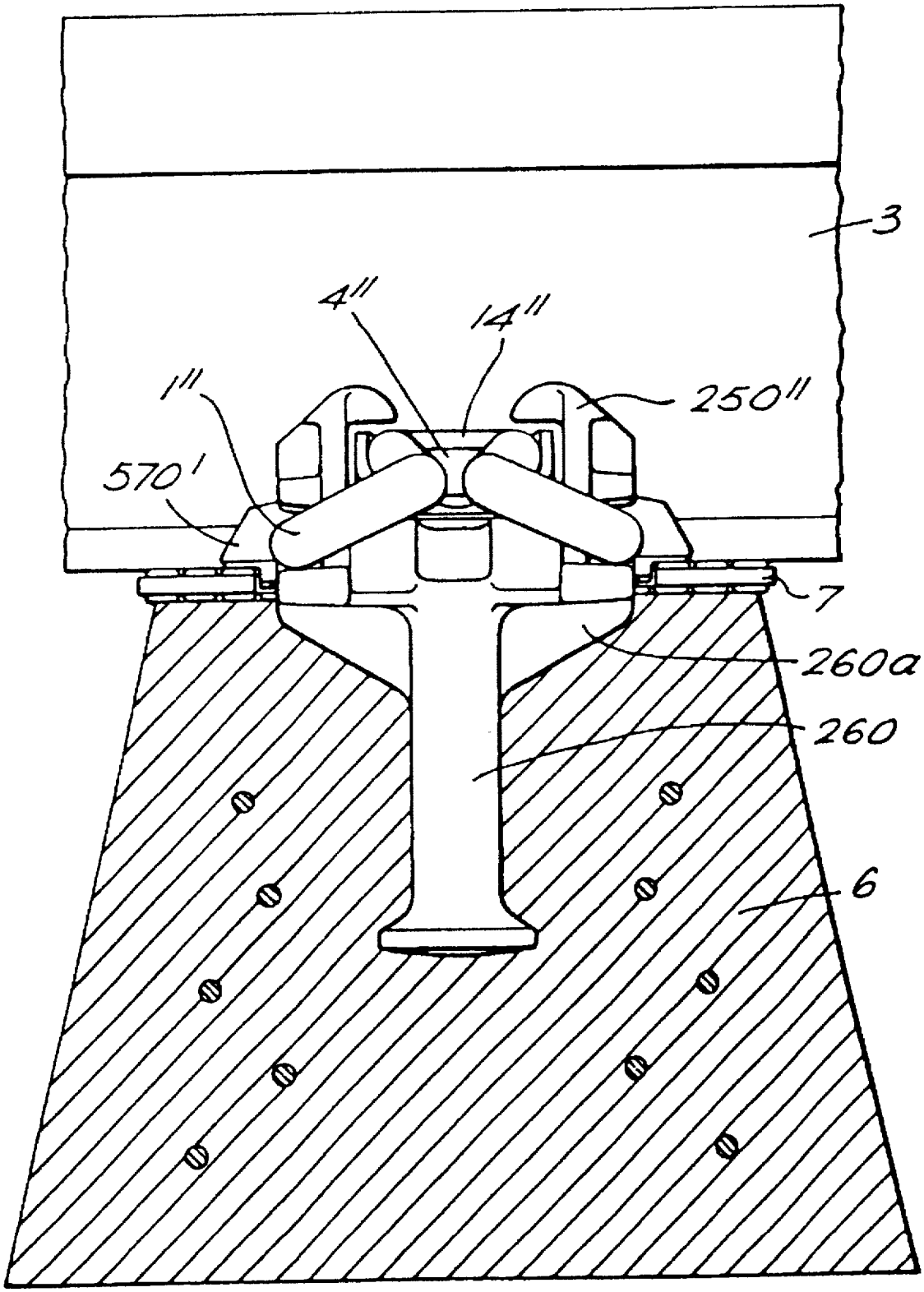
Figure 11C:
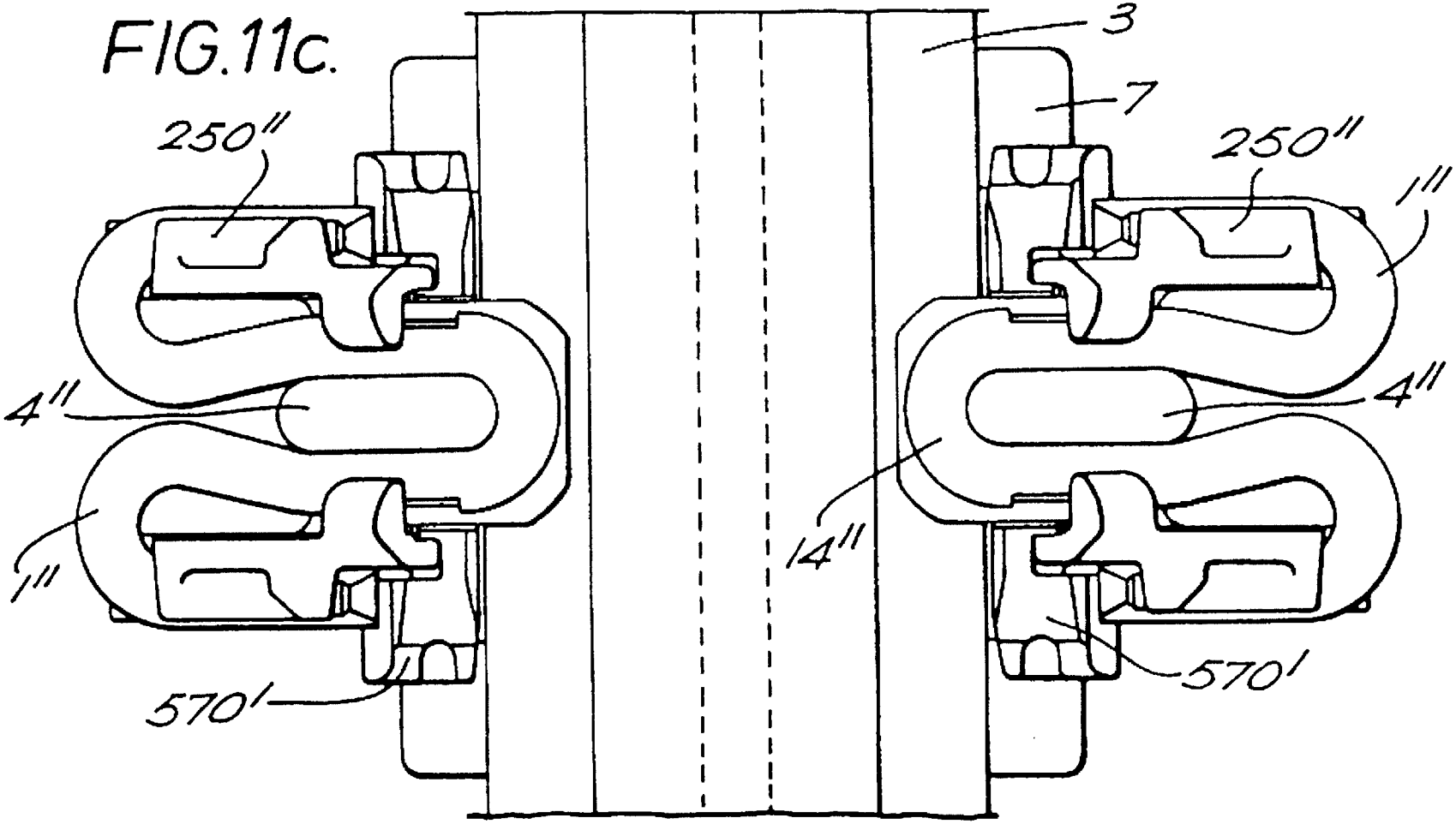
Figure 12A:
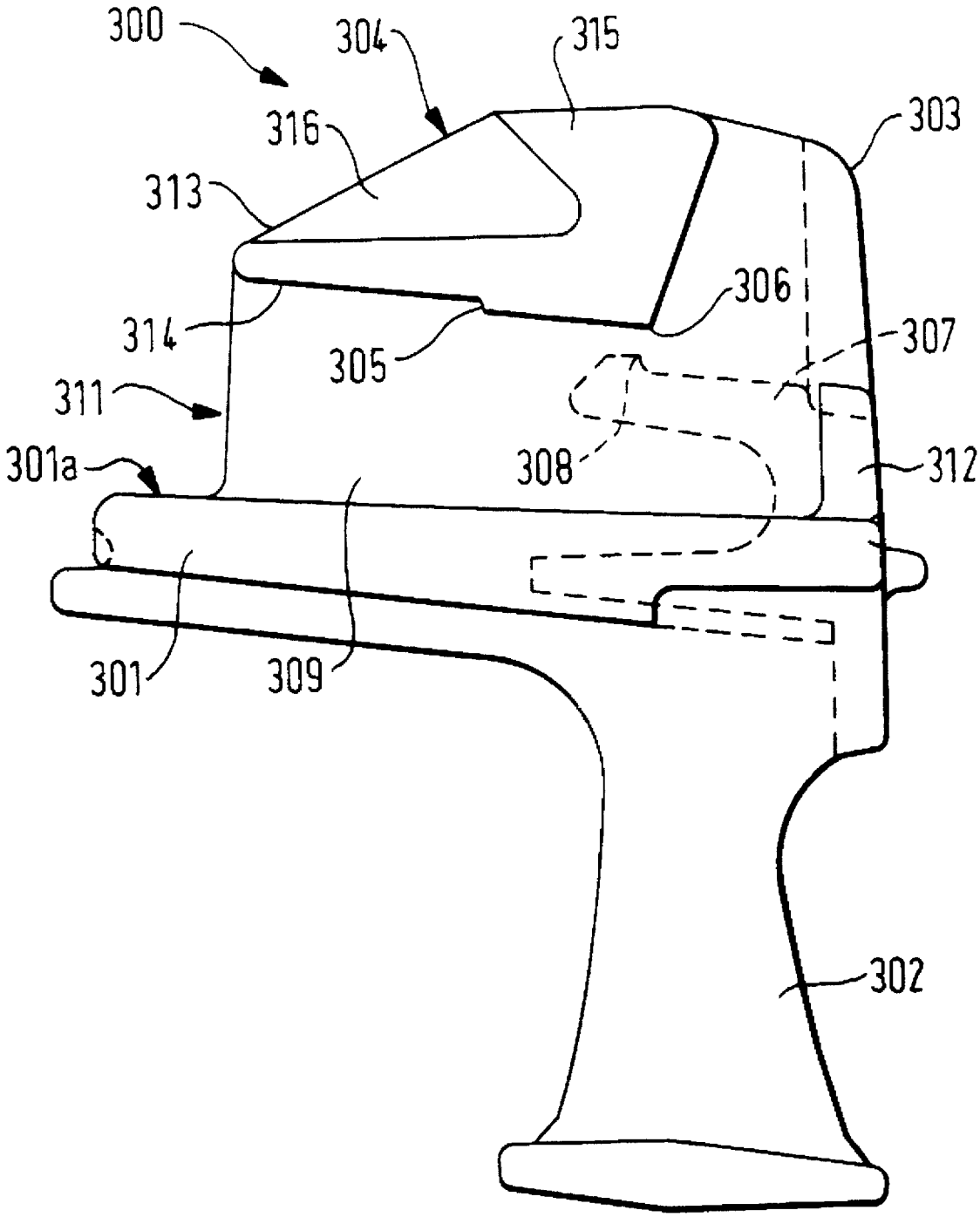
Figure 12B:
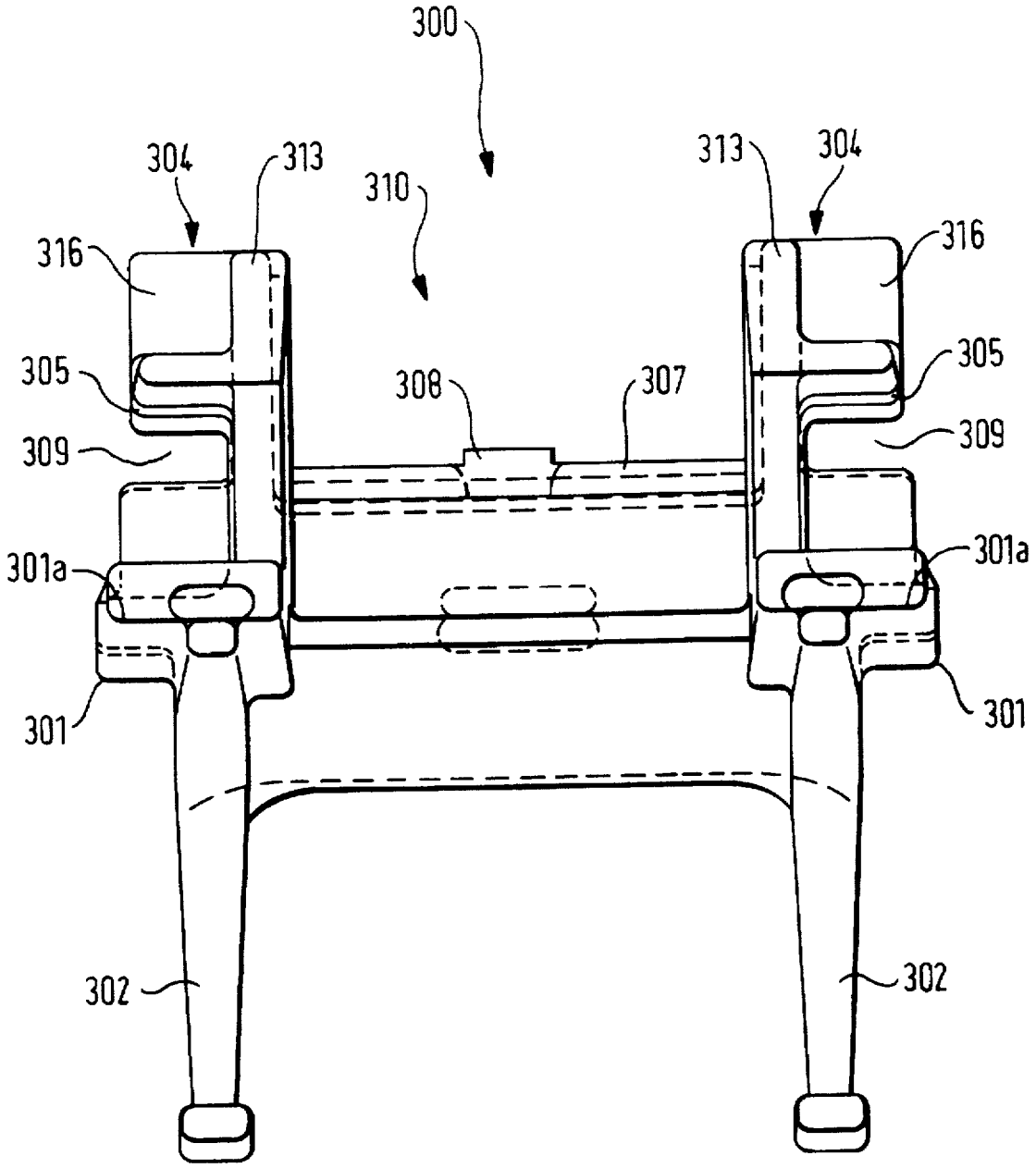
Figure 12C:
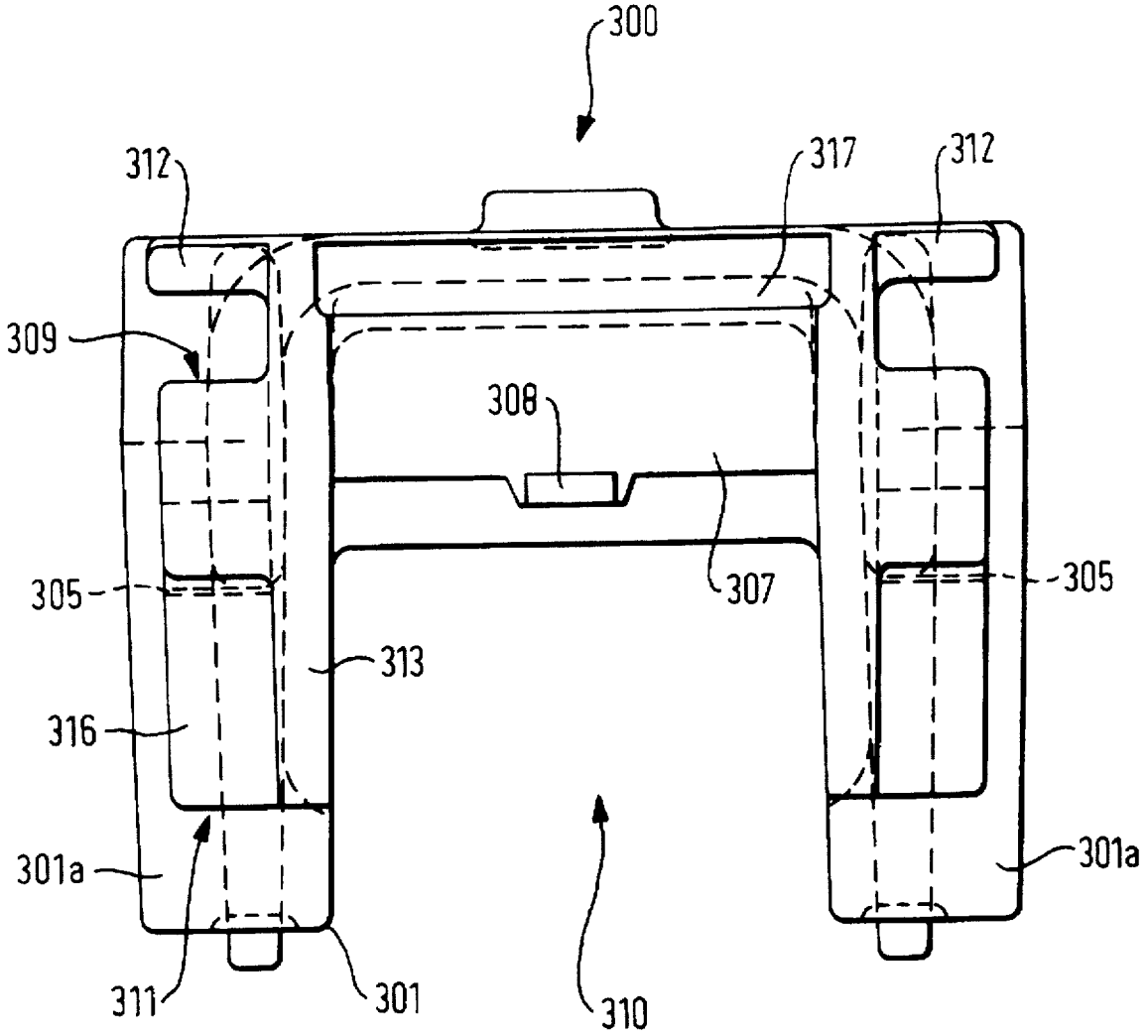
Figure 13A:
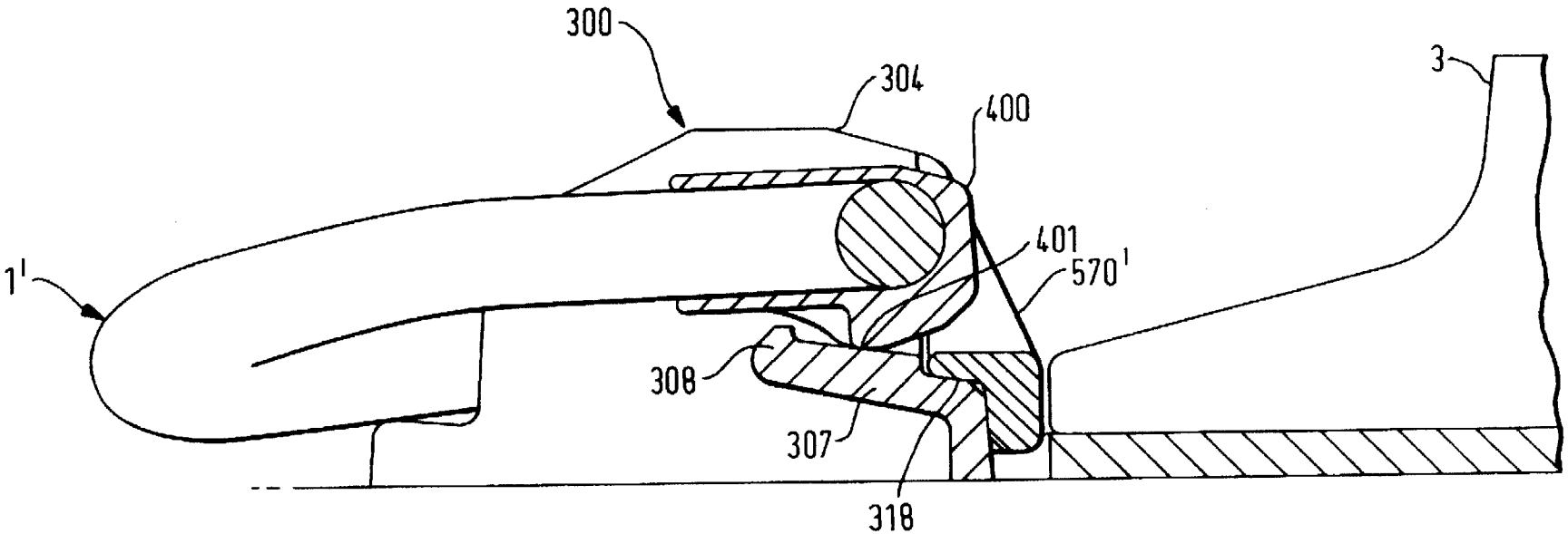
Figure 13B:
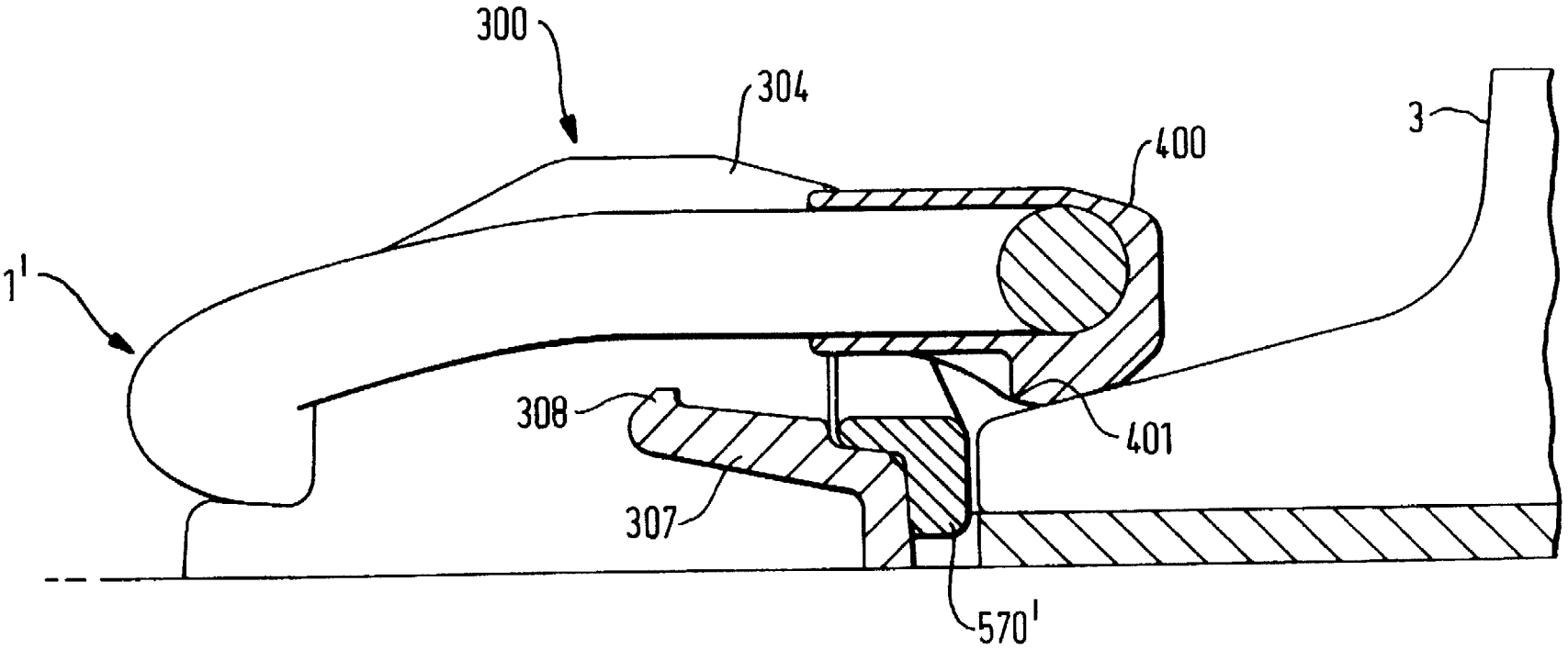
Figure 13C:
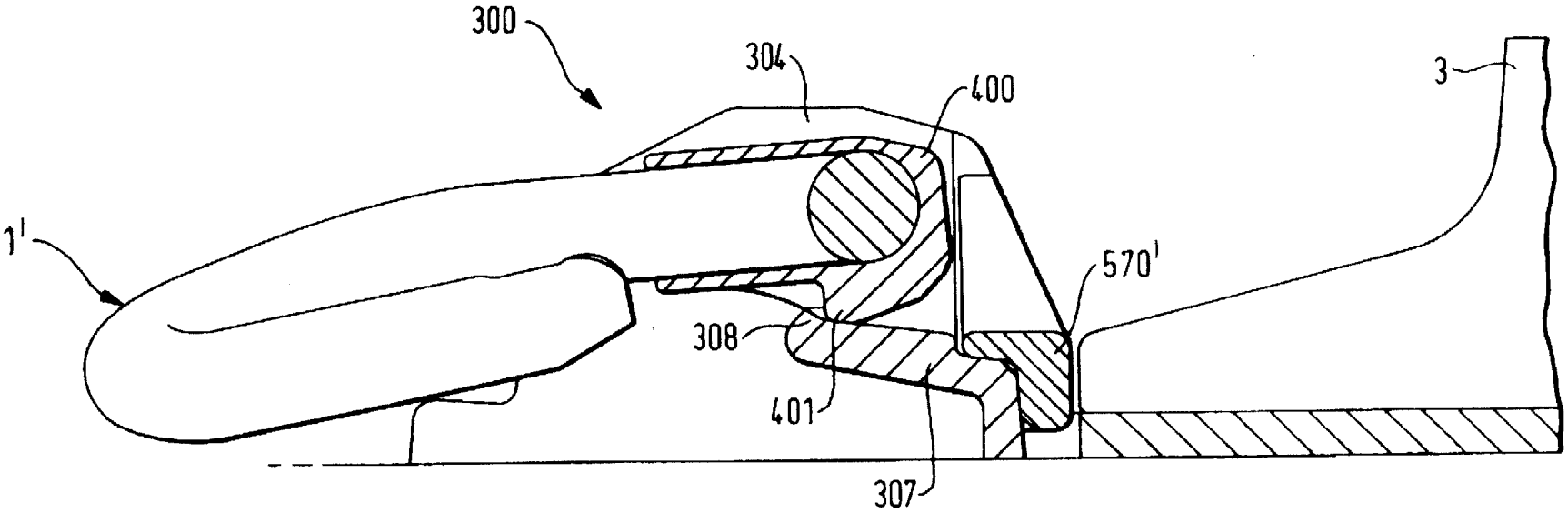
Figure 14A:
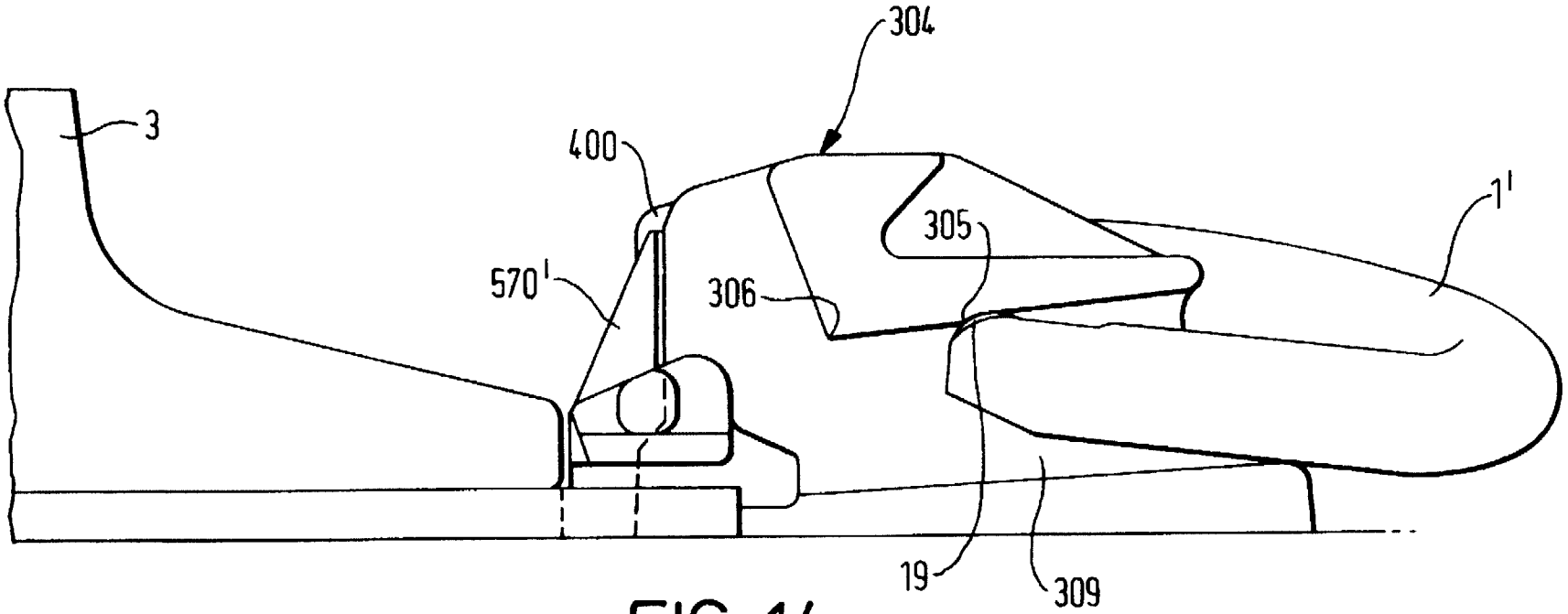
Figure 14B:
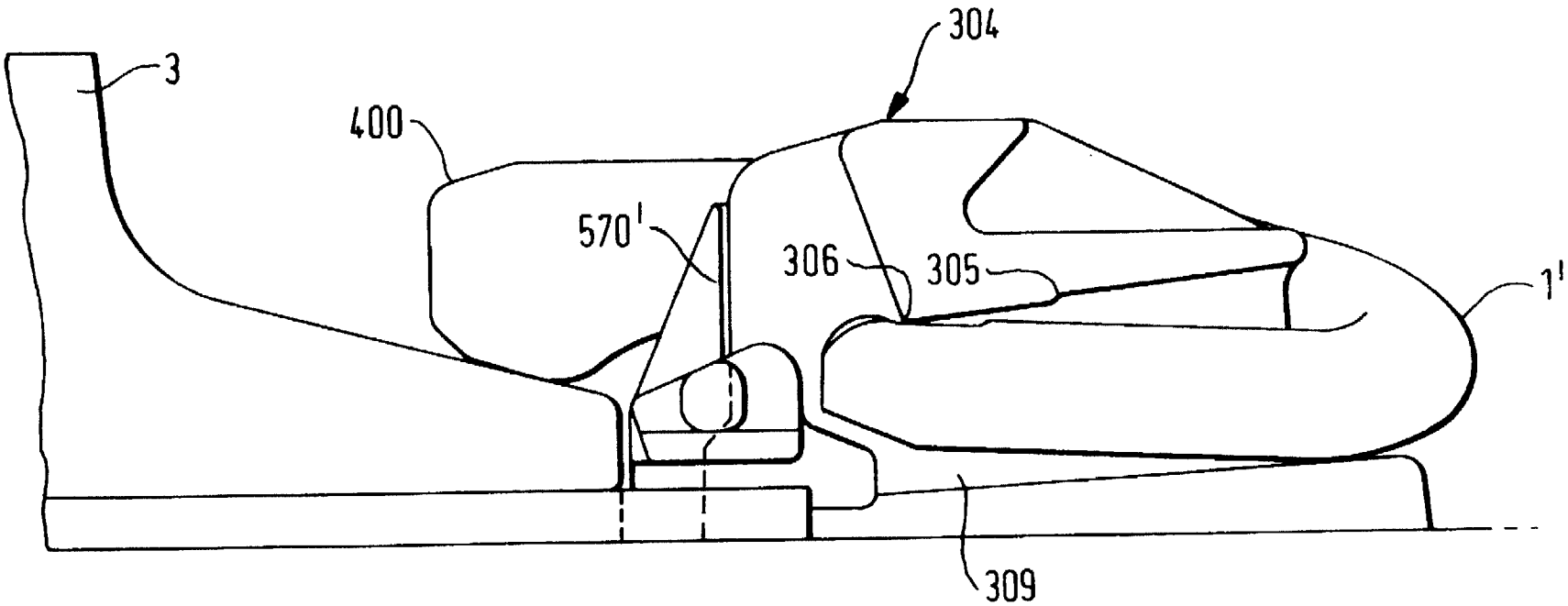
Figure 14C:
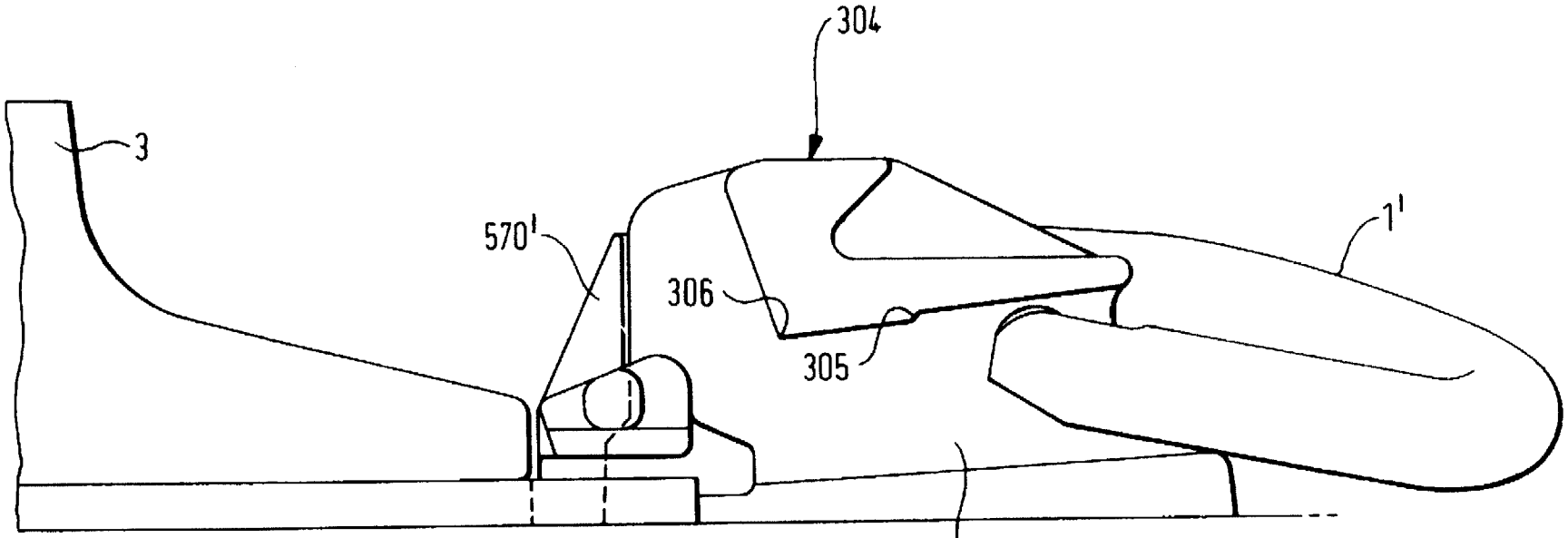

Reference will now be made, by way of example, to the accompanying drawings, in which:

FIGS. 1*a*, 1*b* and 1*c* show respective plan, side elevational and front elevational views of a railway rail fastening assembly;

FIGS. 2*a* and 2*b* show respectively a plan view of a railway rail fastening clip shown in FIG. 1 and a side view of the clip as it appears when free from stress;

FIGS. 3*a* , 3*b* and 3*c* show plan, side and front elevational views of the anchoring device of FIGS. 1*a* to 1*c* respectively;

FIGS. 4*a*, 4*b* and 4*d* show respective side, plan, and rear views of another railway rail-fastening clip assembly, and FIG. 4*c* shows an enlarged part of that assembly;

FIGS. 5*a*, 5*b* and 5*c* show respective enlarged views of parts of a clip and anchoring device combination;

FIG. 6 shows another railway rail-fastening assembly;

FIGS. 7*a*, 7*b* and 7*c* show respective plan, side elevational and rear elevational views of a rail fastening clip shown in FIG. 6, and FIGS. 7*d* and 7*e* show respective enlarged plan and side elevational views of part of that clip;

FIGS. 8*a*, 8*b* and 8*c* show respective plan, side elevational and front elevational views of an anchoring device shown in FIG. 6;

FIGS. 9*a*, 9*b* and 9*c* show respective plan, side elevational and front elevational views of an alternative form of the anchoring device shown in FIG. 6;

FIGS. 10*a*, 10*b* and 10*c* show views for use in explaining respective steps of a method of fastening a railway rail;

FIGS. 11*a*, 11*b* and 11*c* show respective side elevational, rear elevational and plan views of another railway rail-fastening assembly;

FIGS. 12*a*, 12*b* and 12*c* show respective end, rear and plan views of a railway rail anchoring device or shoulder embodying the present invention;

FIGS. 13*a*, 13*b* and 13*c* show respective sectioned partial end views of a railway rail fastening assembly including an anchoring device embodying the present invention; and FIGS. 14*a*, 14*b* and 14*c* show partial end views corresponding to the views shown in FIGS. 13*a*, 13*b* and 13*c* respectively.

FIGS. 1*a*, 1*b* and 1*c* show a railway rail fastening assembly comprising a railway rail fastening clip 1, a clip shoulder or anchoring device 2 by which the clip 1 is being held in a position where it is bearing down on a railway rail 3 adjacent to the anchoring device 2, a "toe" insulator 4 carried by the clip 1 which is thereby electrically isolated from the rail 3, and a "post" insulator 5 located between the rail 3 and the anchoring device 2 for electrically isolating the device 2 from the rail 3. The rail 3 is supported on a rail foundation 6, there being a resilient rail pad 7 provided between the bottom of the rail 3 and the foundation 6 as in conventional assemblies. For clarity, FIG. 1*c* shows only the clip and anchoring device.

The clip illustrated in FIGS. 1*a* to 1*c* is shown more clearly in FIGS. 2*a* and 2*b*, which show respectively a plan view and a side view as the clip appears when free from stress (for example when not retained by the anchoring device). Referring to FIG. 2*a*, it can be seen that the clip has in plan approximately the shape of a letter M. It is formed from a rod of resilient material (which in this example is 450 mm long, of circular cross-section and of 15 mm diameter) bent so as to have, proceeding from one end A of the rod to the other end B, a first portion 11 which is substantially straight, a second portion 12 which is bent through more than 180°, a third portion 13 which is substantially straight, a fourth portion 14 which is bent through 180°, a fifth portion 15 which is substantially straight, a sixth portion 16 which is bent through more than 180°, and a seventh portion 17 which is substantially straight. The first and seventh portions 11 and 17 can be regarded as the outer legs of the M, whilst the third and fifth portions 13 and 15 can be regarded as the inner legs of the M. The clip is symmetrical about the line X—X in FIG. 2*a*. In plan, as in FIG. 2*a*, the longitudinal axes of the first, third, fifth and seventh portions, 11, 13, 15 and 17 appear to be substantially parallel. The inwardly-facing surface of each outer leg of the clip is provided with a pair of detents 8 the purpose of which, as will be explained later in more detail, is to locate the clip with respect to the anchoring device 2 and, hence, also to the rail 3.

The assembly shown in FIGS. 1*a* to 1*c* can employ a clip which differs in shape from the one shown in FIGS. 2*a* and 2*b*.

The anchoring device 2 shown in FIGS. 1*a* to 1*c* will now be described with reference to FIGS. 3*a*, 3*b* and 3*c* which show plan, side and front elevational views of the anchoring device respectively.

The anchoring device 2 has a pair of clip-retaining members 21, which extend upwardly when the device is in use. The clip-retaining members 21 have respective first main faces 21*a* which oppose one another, are mutually-parallel and are joined together by a connecting base member 22 of the device which extends between a lower corner of one of the clip retaining members 21 and a corresponding lower corner of the other clip-retaining member 21 such that the said first main faces 21*a* extend alongside one another. The first main faces 21*a* of the clip-retaining members 21 define therebetween an opening 23 in the device for receiving the third, fourth and fifth portions 13, 14 and 15 of a clip 1. In a second main face 21*b* of each of the clip retaining members 21 there is provided a first recess 21*c* forming a passageway for receiving one of the first and seventh portions 11 and 17 of the clip 1. The first recess 21*c* adjoins a second recess 21*d* provided in the second main face 21*b* below one end of the first recess 21*c*, such that when looking directly towards the second main face 21*b* the floor of the passageway appears to have a step in it. At respective upper corners of the first main faces 21*a* of the clip retaining members 21, directly above the lower corners thereof joined together by the said base member 22, the clip retaining members 21 are provided with inwardly-extending projections 21*e* which are such that they lie directly over part of the third and fifth portions 13 and 15 of the clip respectively when the clip is installed in the device and the fourth portion 14 thereof is resting on the rail. These projections 21*e* serve to prevent the inner legs of the clip being forced upwards to an unacceptable extent by tilting of the rail, and so are useful where the clip (as in FIG. 1*a*) does not have legs which overhang the rail (unlike the clip of FIGS. 3*d* and 3*e*).

The top of each clip-retaining member 21 is such that when viewed from the front and from the side it has in profile the shape of an irregular triangle. The face joining that end of the clip-retaining member 21 which is at the front of the anchoring device 2 to the uppermost point of the device is inclined to the horizontal by 32°, whereas the face joining the opposite end of the clip-retaining member 21 to the uppermost point is inclined to the horizontal by 20°. Respective faces joining the first and second main faces of the clip retaining member 21 to the uppermost point are inclined to the horizontal by 19° and 45° respectively.

By way of example only, dimensions of various parts of the anchoring device 2 described with reference to FIGS. 3*a* to 3*c* will now be given.

The anchoring device is 100 mm wide between the second main faces 21*b* of the clip-retaining members 21, which are each 70 mm long and 22.5 mm wide and define an opening therebetween of 55 mm. The first recess 21*c* therein is 13.5 mm wide in the horizontal direction and 16 mm wide in the vertical direction, the second recess 21*d* being 20 mm long, 13.5 mm wide in the horizontal direction and 10 mm in the vertical direction. The overall height of the anchoring device is 66 mm, the height of the base member 22 being 15 mm, a lowermost surface of each of the inwardly-extending projections 21*e* being 34 mm therefrom, and the uppermost point of the second main face 21*b* of the clip-retaining member 21 being 57 mm high. The separation between the projections 21*e* is 32 mm, and the distance between the uppermost points of the anchoring device 2 is 76 mm. The uppermost point of the device 2 lies 20 mm from the front thereof, as measured horizontally.

As mentioned earlier, the clip described with reference to FIGS. 2*a* and 2*b* has pairs of detents 8 on each outer leg. This feature will now be described in more detail with reference to FIGS. 4*a* to 4*d*, which show respective side, plan, partially enlarged and rear views of a railway rail fastening clip 100 which is M-shaped in plan, and FIGS. 5*a*, 5*b* and 5*c* which show respective enlarged views of parts of a clip and anchoring device assembly employing such detents 8.

The clip 100 is formed from a rod of resilient material bent so as to have, proceeding from one end A of the rod to the other end B, a substantially straight first portion 101, a bent second portion 102, a substantially straight third portion 103, a bent fourth portion 104, a substantially straight fifth portion 105, a bent sixth portion 106, and a substantially straight portion 107. When viewed from above, the longitudinal axes of the first, third, fifth and seventh portions appear to be mutually-parallel. The longitudinal axes of the second and sixth portions 102 and 106 lie in respective planes which are inclined with respect to one another and also with respect to a plane containing the longitudinal axes of the first and seventh portions. The third and fifth portions thereby lie in a further plane which is above the plane containing the first and seventh portions when the clip is in use. The clip is shown in combination with an anchoring device 200 comprising clip-retaining members 201 which extend upwardly when the device is in use and having passageways therein for receiving the first and seventh portions of the clip 100 respectively. The opening 209 in each device 200 into which the third 103, fourth 104 and fifth 105 portions of the clip 100 are inserted when the clip is in use is wedge-shaped in cross-section. This enables the rail foundation to which the anchoring device 200 is attached to be lifted indirectly using a lifting tool having a lifting member shaped so as to fit the lower region of the opening in the device. On the inwardly-facing surface of each outer leg of the clip 100 there is formed a pair of detents 8*a* and 8*b*, spaced from one another in a direction parallel to the longitudinal axes of the first and seventh portions, which cooperate with a corresponding rounded projection provided on an outwardly-facing vertical wall of each passageway. As shown in FIG. 4*a* in full lines when the projection 9 provided in each passageway in the anchoring device is engaged with the detent 8*a* which is furthest from the associated free end of the clip the clip is retained in a "switched-in" position in which it bears on the rail. However, it is possible for the clip to be driven out of that position, through application of force to the clip in the direction away from the rail, such that the projection 9 on the anchoring device comes out of the detent 8*a*. The projection 9 can then engage with the other detent 8*b* so as to retain the clip in a "switched-out" position (shown in dotted lines) in which it rests on the anchoring device. Similarly, the clip may be driven in the opposite direction so as to move from its position on the anchoring device to its position on the rail. This enables the clip to be installed and held in the anchoring device, in its "switched-out" position, before a rail is laid on the rail foundation (and possibly even before the anchoring device itself is incorporated in the rail foundation), which greatly facilitates the driving of clips by automatic machinery when the rail is in place. Furthermore, the clip need not be removed completely from the anchoring device when for any reason it is desired to release the rail from the clip.

FIG. 5*a* shows the detents 8*a* and 8*b* and projection 9 in greater detail. FIG. 5*b* shows an alternative arrangement in which the clip is provided with a projection 8 and an anchoring device is provided with detents 9*a* and 9*b*. This arrangement operates in exactly the same way as the arrangement of FIG. 5*a*. FIG. 5*c* shows an arrangement in which the clip has a kink formed in it so as to provide a projection 9*c* and the anchoring device has a steep-sided notch 8*d* in a face thereof, the projection 9*c* being able to engage either with the notch 8*d* or a corner of the anchoring device 8*c*.

It should be noted that the means of locating the clip with respect to the anchoring device can take other forms and that the detent/notch or projection can be provided on either the outer legs or the inner legs of an M-shaped clip. Furthermore, as apparent from the earlier description of FIG. 1*a*, the locating means can be applied to all forms of M-shaped clip, including that of FIG. 1*a* and not only the form of clip shown in FIGS. 4*a* to 4*d*. A further example of such a clip is described below with reference to FIGS. 7*a* to *7e*. Finally, it is conceivable that more than two detents/notches could be provided on each outer or inner leg of the clip, or on the anchoring device, so as to allow for the retention of the clip in more than two positions with respect to the anchoring device. For example, as explained below in more detail with reference to FIGS. 10*a* to 10*c*, it may be desirable to have three locating positions for the clip, one in which the clip bears down on the rail, one in which the clip bears on a post insulator to permit adjustment of the rail, and one in which the clip does not rest on the post insulator so as to allow replacement thereof.

Since the clip is intended to be able to "switch" into or out of its position bearing on the rail, it is important in many cases that stray ballast from the track does not impede movement of the clip by getting stuck in the region bounded by the third and fifth portions of the clip. For this reason, the third, fourth and fifth portions of a clip are preferably shaped so as to bound an area which is widest at the end thereof bounded by part of said fourth portion and is narrowest at the end opposite thereto.

FIG. 6 shows another rail-fastening assembly, as claimed in the U.S. patent application Ser. No. 08/474,181 now abandoned of which the present application is a continuation-in-part, which comprises a resilient railway rail-fastening clip 1' (which is claimed in U.S. patent application Ser. Nos. 08/244,716 now abandoned of which 08/474,181 now abandoned is a divisional) having a toe portion 14' which bears against a flange of a railway rail 3 supported by a rail foundation 6, the rail foundation 6 being cushioned from the rail 3 by means of a resilient rail pad 7 located between the base of the rail and the rail foundation 6. The rail clip 1' is held in place by an anchoring device or shoulder 250, the shoulder 250 having a pair of passageways 253 (only one of which is shown in FIG. 6) in which respective limbs 11', 17' (only limb 17' being shown in FIG. 6) of the clip are located. The toe portion 14' of the clip 1' carries an insulator 4' covering the lowermost surface of the toe portion 14', so that the toe portion 14' of the clip 1' bears on the rail flange through the insulator 4', which thereby insulates the clip 1' from the rail 3. Located between the rail 3 and the shoulder 250 is a "side post" insulator 570, for electrically isolating the shoulder 250 from the rail 3. The components in the assembly will now be described in more detail.

As shown in FIGS. 7*a*, 7*b* and 7*c*, the clip 1' shown in FIG. 6 is substantially M-shaped in plan. It is made by bending a rod of resilient material, which is, in this case, circular in cross-section (for example a steel rod 15 mm in diameter), so as to have, proceeding from one end A of the rod to the other end B, a straight first portion 11', a second portion 12' bent through 180°, a curved third portion 13', a fourth portion 14' which is bent through 180°, a curved fifth portion 15', a sixth portion 16' which is bent through 180° and a straight seventh portion 17'. The first and seventh portions 11' and 17' of the clip constitute the outer legs of the M, the third and fifth portions 13' and 15' constitute the inner legs of the M, the second and sixth portions 12' and 16' join respective inner legs to the outer legs, and the fourth portion 14' of the clip joins together the inner legs. When viewed in plan, as in FIG. 7A, the fourth portion 14' of the clip extends beyond the free ends A and B of the first and seventh portions 11' and 17'.

The second and sixth portions 12' and 16' of the clip 1' rise out of the plane containing the first and seventh portions 11' and 17' of the clip 1' such that no rising part of the longitudinal axes of those portions 12' and 16' is inclined to that plane by an angle greater than about 33°, although in other assemblies this angle may be up 40°.

The third and fifth portions 13' and 15' of the clip 1' are curved such that their longitudinal axes lie in respective planes which are substantially perpendicular to the plane containing the first and seventh portions 11' and 17' of the clip. Each of the third and fifth portions 13' and 15' in the illustrated clip has a first substantially straight part 13*a*, 15*a* and a second substantially straight part 13*b*, 15*b*, the longitudinal axes of which parts are inclined to one another at an angle of about 30°. However, the first and second parts 13*a*, 13*b*, 15*a*, 15*b* of the third and fifth portions 13' and 15' could themselves be curved so that the third and fifth portions 13' and 15' are curved more smoothly overall.

When a clip is bearing on the rail, as shown in FIG. 6, a plane containing the longitudinal axis of the fourth portion 14' is substantially parallel to the plane containing the first and seventh portions 11' and 17'.

For the clip shown in FIGS. 7*a* to 7*c*, the ratio of the maximum distance between the longitudinal axes of the third and fifth portions 13' and 15' and the plane containing the first and seventh portions 11' and 17' to the diameter of the rod forming the clip is 1.23. A preferred maximum value for this ratio is 2.0, but it could be as high as 4.0.

The outer legs of the clip, i.e. the first and seventh portions 11' and 17' thereof, are each provided with detents 18 on their upper surface adjacent to the respective free ends A and B of the clip. The end B of one of the outer legs of the clip (which in this embodiment is identical to the other outer leg) is shown in more detail in FIGS. 7*d* and 7*e*.

The detents 18 are each shaped so as to have two faces 18*a*, 18*b* which are inclined in opposite respective directions with reference to the longitudinal axes of the first and seventh portions 11' and 17' and another face 18*c* forming the floor of the detent 18 which joins together the inclined faces 18*a*, 18*b* and is itself substantially parallel to the longitudinal axes of the first and seventh portions 11' and 17'. The inclined faces 18*a*, 18*b* are inclined at an angle of 30° with respect to the longitudinal axes of the first and seventh portions 11' and 17'. The floor 18C of the detent serves to space apart the inclined faces 18*a*, 18*b* of the detent 18, but in an alternative this floor 18*c* may be omitted so that there is no space between the lowermost edges of the inclined faces 18*a*, 18*b* of the detent 18. The detent 18 is preferably on the uppermost surface of the first and seventh portions 11' and 17' of the clip as shown, rather than on a lateral face thereof, so that when the clip 1' is installed in an anchoring device 250 the force on the outer legs of the clip caused by the engagement of the anchoring device 250 with the detents 18 is in substantially the same direction as the stress acting on the second and sixth portions 12' and 16' of the clip 1' owing to deflection of the outer legs.

Each free end A,B of the clip 1' is tapered on its upper and lower surfaces, the upper and lower tapered surfaces 19*a*, 19*b* being at an angle of approximately 30° with respect to the longitudinal axis of the clip. The detent 18 is formed just behind the tapered part 19*a* of the upper surface. As will be clear from the description of FIGS. 10A to 10C later on, the taper 19*a* on the upper surface of the outer leg is intended to ease insertion of the clip 1' into an anchoring device 250. The taper 19*b* on the lower surface of the outer leg is intended to facilitate use of the clip in holding the insulator 570 in place between the anchoring device 250 and the rail 3.

In such a clip made from a rod of diameter 15 mm: the inwardly-facing surfaces of the outer legs are 75 mm apart; the distance between the outermost part of the fourth portion 14' and a line joining the outermost parts of the second and sixth portions 12' and 16' is 120 mm; the maximum height of the clip, i.e. the height between the uppermost point of the third portion 13' of the clip above the lowermost point of the first and seventh portions 11' and 17' of the clip, is 34 mm; the lowermost point of the fourth portion 14' of the clip is 10 mm above the lowermost portion of the first and seventh portions 11' and 17'; the outermost portion of the fourth portion 14' extends 40 mm beyond the free ends A and B of the outer legs; the second parts 13*b*, 15*b* of the third and fifth portions 13' and 15' are each 42 mm long; the radius of curvature of the second and sixth portions is 10, whilst that of the fourth portion is 9; the upper surface of the outer legs are tapered to a distance of 8 mm from the free end of the leg, the lower surface of the outer legs being tapered to a distance of 10 mm from the end of the leg; each detent 18 is 1.5 mm deep, being 9 mm across at its widest part perpendicular to the longitudinal axis of the outer leg, having a floor 18*c* 8.5 mm long as measured in the direction parallel to the longitudinal axis of the outer leg, and being 15.5 mm long overall; in forming the detent 18 and the upper face taper 19*a*, material is preferably taken away from the end of the free leg such that it has a diameter of 14.5 mm as measured across the leg at the point where the upper face taper 19*a* meets the detent 18; the angle α shown in FIG. 7*c* is about 12°, but could in other embodiments be 19° for example or up to 25°.

The clip shown in FIGS. 7*a* to 7*e* is used, as shown in FIG. 6, with an anchoring device as shown in FIGS. 8*a* to 8*c*, although this anchoring device may be modified in some respects, for example as shown in FIGS. 9*a* to 9*c*.

The anchoring devices 250 of FIGS. 8*a* to 8*c* and 9*a* to 9*c* comprise a base member 251, which extends substantially horizontally when the device is in use, and a pair of clip-retaining members 252 which are connected at one end thereof to either end of the base member 251 so as to extend substantially perpendicularly thereto both vertically and horizontally. A channel formed in the outwardly-facing wall of each clip-retaining member 252 provides a passageway 253 for receiving the outer legs of the clip of FIGS. 7*a* to 7*e*. The clip-retaining members 252 are spaced apart by the base member 251 so as to define an opening 254 therebetween for receiving the inner legs of the clip. Overhanging the opening 254 from the top of each clip-retaining member 252 are inwardly-extending projections 255, which projections 255 serve to limit upward movement of the inner legs of the clip which may occur due to rail tilt when the clip is in use. Each passageway 253 has an opening 256 at the end of the clip retaining member 252 which is furthest from the base member 251, but is closed by a wall 257 at the other end of the clip-retaining member 252 so as to provide means by which the insulator 570 may be located on the anchoring device 250, as will be explained later in more detail. For this purpose also, the roof of the passageway adjacent to the wall 257 is removed.

When the anchoring device 250 is in use, the floor of the passageway 253 is substantially horizontal. The passageway 253 has only one side face, constituted by a wall 252*a* of the clip-retaining member 252 formed so as to lie between the outer and inner legs of the clip 1' when in use, the other side of the passageway being open. The roof of the passageway 253 is formed so as to have a sloping part 253*a* which is inclined with respect to the horizontal when the device is in use such that the passageway is taller at the part of that sloping part 253*a* which is closer to the opening 256 than it is at the other end of the part 253*a*, the roof of the passageway 253 being formed at either end of the sloping part 253*a* in such a way as to provide projections 253*b* and 253*c* for cooperating with the detent 18 formed in the outer leg of each clip 1' for locating the clip 1' at a particular location with respect to the anchoring device 250.

The first projection 253*b* which is formed at the opening 256 of the passageway 253 presents to the opening 253 a first face 253*b*, which is fairly shallowly inclined to the horizontal in a direction such that the height of the passageway decreases proceeding towards the wall 257. The projection 253*b* then has a second face 253*b*", which is more steeply inclined with respect to the horizontal, but in the opposite sense, than the first face 253*b*' such that the height of the passageway increases. The second projection 253*c* which is formed closest to the wall 257 has a first face 253*c*' forming the sloping part 253*a* and a second face 253*c* " which is inclined in the opposite sense with respect to the horizontal by an angle which is greater than the angle of inclination of the sloping part 253*a*, but is smaller than the angle of inclination of the second face 253*b*" of the first projection 253*b*. Extending from each wall 252*a* of the clip-retaining members 252 in a region above the passageways 253 is a part 258 such that between the passageway 253 and the part 258 there is defined a recess 259 into which a tool, for installing a clip into or removing a clip from the device, or for lifting a sleeper to which a pair of anchoring devices 250 have been secured, may be inserted. The roof of the recess 259 may be sloped along one edge as shown. The wall 252*a* of each clip-retaining member 252 may be rounded or sloped along one edge as shown so as to reduce the amount of material required to make the anchoring device 250.

The floor of the passageway 253 is preferably extended beyond the opening 256 so as to provide a part 253*d* against which the lower surface of the outer legs of the clip may rest when the clip is about to be installed in the device 250. The base member 251, which provides a support for the fourth portion 14' of the clip 1' when it is not bearing on the rail, is in this assembly intended (when in use) to receive a side post insulator 570, a step 251*a* being provided in the face of the base member 251 which is closest to the rail 3 when the device 250 is in use for receiving a horizontally-extending part of the insulator 570. It should be noted, however, that this step 251*a* would not be required if the anchoring device 250 were to be used with a conventional insulator for electrically isolating the device from the rail.

Further savings in the material needed to make the device 250 may be achieved by omitting the overhanging projections 255, thereby enabling the overall height of an anchoring device 250' to be reduced, as shown in FIGS. 9*a* to 9*c*. The parts 258 have also been omitted from the device of FIGS. 9*a* to 9*c*, although the upper part of this device 250' could be modified so as to provide a recess for receiving installation or lifting tools.

In one embodiment of the anchoring device shown in FIGS. 8*a* to 8*c*, for use with a clip as described with reference to FIGS. 7*a* to 7*e*, the overall height of the anchoring device is 60 mm and its overall width is 101 mm. The clip-retaining members 252 define an opening between them which is 57 mm wide, the walls 252*a* being 9 mm wide. The lowermost surface of each overhanging part 255 is 46 mm above that part of the anchoring device which will be level with surface of the rail foundation 6 when the device is in use, the separation between the overhanging parts 255 being 32 mm. The part 253*d* extends beyond the opening 256 of the passageway 253 a distance 11 mm, the length of the passageway from the inner wall 257 to the opening 256 being 77 mm. The wall 257 is 8 mm thick as measured in a direction parallel to the length of the passageway 253 and is 21 mm high. The thickness of the floor of the passageway is 3 mm and the height of the passageway at the opening is 22 mm. The height of the passageway then decreases at an angle of about 13° to a height of 20 mm before increasing again at an angle of about 45° to a height of 24 mm. The sloping part 253*a* of the passageway roof is inclined at an angle of about 18° and at is lowermost point is 18.5 mm above the floor of the passageway 253. The second face 253*c*" of the second projection 253*c* is inclined at an angle of 30° to a height of 24 mm, the lowermost point of the second projection 253*c* being 26 mm from the outer face of the wall 257. The lowermost point of the first projection 253*b* is 68 mm from the outer face of the wall 257. The recess 259 above the passageway 253 has an upper surface which is inclined at an angle of about 15° starting at a height of 44 mm above the lowermost point of the anchoring device and increasing to 51 mm, the floor of the recess being 32 mm above the lowermost point of the anchoring device. The step 251*a* formed in the base member 251 is formed at a height of 15 mm above the lowermost point of the anchoring device and is of depth 8 mm.

Installation of the clip 1' into an anchoring device 50 as shown in FIG. 6 will now be explained with reference to FIGS. 10*a* to 10*c* (the toe insulator 4' that would normally be carried by the clip 1' being omitted for clarity in these Figures). FIG. 10*a* shows the clip in an initial position, as it is when it is about to be driven into the device 250, 15 with the fourth portion of the clip 1' resting (via a toe insulator 4', not shown) on the base member 251 of the anchoring device 250 and the outer legs of the clip 1' just inside the passageways 253 of the anchoring device 250 such that part of the lower surface of the outer legs rests on the portion 253*d* of the anchoring device 250, the face 18*a* of the detent 18 which is closest to the free end of the outer leg is in contact with the second face 253*b*" of the projection 253*b*, and the upper tapered surface 19*a* of the outer leg is partly in contact with the sloping part 253*a* of the roof of the passageway 253. In this position the clip is only partially deflected, for example only 2 mm out of a total deflection of 12 mm.

When the clip is driven into an intermediate position, as shown in FIG. 10*b*, in which the face of the detent 18*b* is brought into contact with the first face 253*b*' of the projection 253*b*, the outer legs are deflected downwardly a little more, bringing the second and sixth portions 12' and 16' of the clip 1' upwardly. In this position, the fourth portion of the clip rests above part of the side post insulator 570, thereby preventing upward movement of that insulator. If the insulator is shaped such that it holds down the rail pad 7, then in this position the clip also serves to retain the rail pad through the insulator. Thus, it is envisaged that the clip, insulator, and preferably also the pad, could be installed on a sleeper provided with an anchoring device 250 in the sleeper factory before being taken to site.

FIG. 10*c* shows the clip as it appears when it has been driven from the intermediate position shown in FIG. 10*b* into a final position where the fourth portion 14' (normally carrying a toe insulator 4') of the clip 1' bears on the rail 3. As the clip is driven horizontally, the sloping roof of the passageway in contact with the upper tapered surface 19*a* of the outer leg urges the outer leg downwardly, thereby deflecting the clip. In the final position of the clip, the detent 18 in the clip 1' is engaged by the second projection 253*c* of the anchoring device 250 and the free ends of the outer legs overlie the locating feet 576 of the side post insulator 570 so that upward movement of the insulator 570 is further restricted. The clip is fully deflected in this position, the fourth portion of the clip lying in a plane which is substantially parallel to the plane containing the first and seventh portions of the clip and the second and sixth portions 12' and 16' of the clip being at their highest point.

When the clip is in its initial position, the insulator is free to move upwardly, so, if replacement of the insulator 570 is required, this may be achieved by driving the clip 1' back into its initial position, without the need to remove the clip 1' completely from the anchoring device 250.

The second and sixth portions 12' and 16' of the clip 1' are, in the initial position of the clip, close to the surface of the sleeper, thereby avoiding a potential problem of rail foot entrapment that could occur when a rail is being lifted from its typical initial position alongside the rear of the anchoring device onto the rail pad 7. This shape of clip, in which the outer legs are deflected downwardly in relation to the inner legs, also allows the overall height of the shoulder to be reduced, thereby permitting it to be lighter and cheaper. Desirably, when a clip 1' is installed in an anchoring device 250 there is a clearance of about 5 mm between the bottom of the toe insulator 4' and the base member 251 of the anchoring device 250 so as to ensure that if the height of the rail is reduced owing to wear of the rail pad beneath it the clip will not be prevented from bearing sufficiently on the rail by the base member 251 of the anchoring device 250.

Another railway rail-fastening assembly is shown in FIGS. 11*a* to 11*c*. The assembly comprises a clip 1" similar to that shown in FIGS. 6 and 7*a* to 7*e*, installed in an anchoring device 250" which is similar to that shown in FIGS. 8*a* to 8*c*, the clip 1" carrying a toe insulator 4" and the anchoring device 250" being electrically isolated from the rail by means of a post insulator 570". The anchoring device 250" is secured to the concrete rail foundation 6 by means of a stem 260 provided so as to project from the base thereof. The stem 260 is embedded in the concrete sleeper during manufacture of the sleeper and is provided with vanes 260*a* to counteract any tendency for the anchoring device 250" to rotate. Although not shown in FIGS. 3*a* to 3*c*, 8*a* to 8*c* and 9*a* to 9*c*, the anchoring devices 2, 250 and 250' will be provided with such a stem 260 if intended for use with concrete sleepers.

It is envisaged that concrete sleeper manufacturers could be supplied with respective clips 1 (or 1'), each clad in a toe insulator 4 (or 4'), and post insulators 5 (or 570), to fit to the anchoring devices 2 (or 250) after they have been cast in concrete sleepers, so that the sleepers can then be supplied to site complete with clips 1 (1') and insulators 4 (4'), 5 (570). When the rail 3 has been satisfactorily threaded between the anchoring devices 2 (250), it is then a simple matter for the clips 1 (1') to be driven further, particularly by machine, into engagement with the rail.

It should be noted that although the assemblies described employ a two-part insulator, i.e. a post insulator for isolating the anchoring device from the rail and a toe insulator for isolating the clip from the rail, since this permits the post insulator to be replaced when worn, it is possible to employ instead a one-part L-shaped insulator, such as is used conventionally, having a portion resting on top of the rail flange where the clip is to bear on it and an adjoining portion located between the side of the rail flange and the anchoring device.

The design of the anchoring devices described with reference to FIGS. 8*a* to 8C and 9*a* to 9*c*, which are claimed in the applicants' co-pending U.S. patent application Ser. No. 08/474,181 now abandoned, is such that an expendable core is required during the manufacture of each device, thereby increasing manufacturing costs appreciably. However, in contrast an anchoring device embodying the present invention can be manufactured using a simple and inexpensive casting technique.

In this respect, in an anchoring device embodying the present invention the non-vertical surfaces are inclined with respect to a horizontal plane and there are no obstructive projections, so that a simple two-part mould can be used to produce the device. Such a design offers significant improvements over the earlier devices. FIGS. 12*a*, 12*b* and 12*c* show end, rear and plan views respectively of an anchoring device embodying the present invention, for use with the clip shown in FIGS. 7*a* to 7*e*.

In order to allow a simple mould to be used, without disrupting the performance of the device, locating means for locating the railway rail clip in a "parked" position before the assembly is fitted on the railway track installation are constituted by an abutment surface provided in the roof of the passageway intermediate the ends thereof. In addition, to allow the clip to be placed in an "insulator change" position, in which the side post insulator may be removed, without the need for the complete removal of the clip from the anchoring device (thereby facilitating maintenance of the track installation, an upstand member is provided. These features will now be described in more detail with reference to FIGS. 12*a*, 12*b* and 12*c*, which show respective end, rear and plan views of an anchoring device embodying the present invention, for use with the clip shown in FIGS. 7*a* to 7*e*.

The anchoring device 300 of FIGS. 12*a* to 12*c* comprises a base member 301, which extends substantially horizontally when the device is in use, and a pair of clip-retaining members 304. Each clip-retaining member 304 is connected at one end thereof to the base member 301 and extends substantially perpendicularly thereto both vertically and horizontally when the device is in use. The clip-retaining members 304 are spaced apart on the base member 301 so as to define an opening 310 therebetween for receiving the inner legs of the clip shown in FIGS. 7*a* to 7*e*.

A channel formed in the outer face of each clip-retaining member 304 provides a passageway 309 for receiving respective outer legs of the clip of FIGS. 7*a* to 7*e*. Each passageway 309 has an opening 311 at one end thereof and is partially closed by a wall 312 at the other end of the clip retaining member 304 so as to provide means by which an insulator 570' may be located on the anchoring device 300, as will be explained later in more detail. For this purpose also, the roof of the passageway adjacent to the wall 312 is removed. When the anchoring device 300 is in use, the floor of the passageway 309 is substantially horizontal.

The passageway 309 has only one side boundary surface, constituted by a wall 313 of the clip-retaining member 304 formed so as to lie between the outer and inner legs of the clip 1' when in use. The other side of the passageway is open. The roof of the passageway 309 is formed, at a location intermediate respective ends of the passageway, so as to have a sloping part 314 which is inclined with respect to the horizontal when the device is in use such that the passageway is taller at the part of that sloping part 314 which is closer to the opening 311 than it is at the other end of the part 314. The roof of each passageway 309 is formed, at a location intermediate respective ends of the passageway, so as to define an abutment surface 305 which engages with a first region constituted by a free end 19, of the inserted outer leg portion of the clip 1', when the clip is held in a pre-assembly position in the device 300, as will be explained below in more detail. The passageway roof 314 ends, closest to the wall 312, at a corner region 306 providing locating means which engage with a second region 18 of the clip 1', when the clip is in a working position, as will be explained in more detail below.

Extending from each wall 313 of the clip retaining members 304 in a region above the passageways 309 is a part 315 such that between the passageway 309 and the part 315 there is defined a recess 316 into which a tool, for installing a clip into or removing the clip from the device, or for lifting a sleeper to which a pair of anchoring devices 300 has been secured, may be inserted. The roof of the region 316 may be sloped along one edge as shown. The wall 313 of each clip retaining member 304 may be rounded or sloped along one edge as shown so as to reduce the amount of material required to make the anchoring device 300.

The floor of passageway 309 is preferably extended beyond the opening 311 so as to provide a part 301*a* against which the lower surface of the outer leg of the clip may rest when the clip is about to be installed in the device 300. The base member 301, which provides a support for the fourth portion 14' of the clip 1' when it is not bearing on the rail, is in this embodiment intended (when in use) to receive a side post insulator 570', a step 318 being provided in the face of the base member 301 which is closest to the rail 3 when the device 300 is in use for receiving a horizontally-extended part of the insulator 570'. It should be noted however that this step 318 would not be required if the anchoring device 300 were to be used with a conventional insulator for electrically isolating the device from the rail.

In one embodiment of the anchoring device shown in FIGS. 12*a* to 12*c*, for use with a clip as described with reference to FIGS. 7*a* to 7*e*, the overall height of the anchoring device is 60 mm and its overall width is 101 mm.

The clip-retaining members 304 define an opening between them which is 57 mm wide, the wall 313 being 9 mm wide. The part 301*a* extends beyond the opening 311 of the passage 309 by a distance 11 mm, the length of the passageway from the inner wall 312 to the opening 311 being 77 mm. The wall 312 is 8 mm thick as measured in a direction parallel to the length of the passageway 309, and is 21 mm high. The thickness of the floor of the passageway is 10 mm and the height of the passageway at the opening is 23 mm. The height of the passageway then decreases at an angle of about 5° to the abutment surface 305, which projects 1 to 2 mm from the passageway roof. The height of the passageway roof then decreases further at an angle of about 5° to a final height, at its lowermost point, of 18.5 mm above the floor of the passageway 209. At this lowermost point, the corner region 306 is defined. The step 318 formed in the base member 301 is formed so as to be 15 mm above the lowermost point of the anchoring device and is of depth 8 mm.

The anchoring device 300 is provided with a intermediate portion 307 which links the two clip-retaining members 304 across the space 310. The portion 307 includes a projection 308 which projects upwardly from the portion 307. The projection 308 is for engagement with a part of the toe insulator 400 (as shown in FIG. 13*c*), which will be explained later.

As can be seen from FIGS. 12*a* to 12*c*, the anchoring device 300 is provided with a pair of anchoring legs 302 which are for securing the device to a sleeper when in use. It is possible to have one or two such legs 302.

FIGS. 13*a* and 14*a* shows an anchoring device with a clip in a preassembly position. The resilience of the clip holds it in place in the anchoring device, and insulators 400 and 570' are held in place by the clip 1'. The clip is held in the preassembly position before being driven into a working position in the device 300. The first region 19 of the clip leg 11 (17) is held in abutting engagement with the abutment surface 305. In particular, the fourth portion of the clip 11 rests (via a part 401 of a toe insulator 400) on the portion 307 of the base member 301, and the outer legs of clip 1' lie inside respective passageways 309 of the anchoring device 300 such that respective end regions 19*a'* of those outer legs are in abutting engagement with respective notches 305. In this position the clip is only partially deflected, for example only 6 mm out of a possible total deflection of 12 mm. In the pre-assembly position, the clip does not bear on the rail 3.

When the clip is driven into a working position, as shown in FIGS. 13*b* and 14*b*, a face of a detent 18*a* of the clip is brought into engagement with the corner region 306 of the clip retaining member 304, the toe insulator 400 is brought into contact with the foot of the rail 3, and the clip deflected such that a holding force is applied to the rail 3 by the clip 1', via the toe insulator 400. In this working position, the clip is held by means of the corner region 306 abutting against the detent 18*a* of the leg portion of the clip.

In order to allow the side post insulator 570' to be changed, for example because of wear, the clip has a third position in the anchoring device 300, shown in FIGS. 13*c* and 14*c*, into which the clip may be driven outwardly from the rail, so that a detent 401 in the underside of the toe insulator 400 is brought into engagement with the projecting member 308 of the intermediate portion 307. The engagement of the toe insulator 400 with the projection 308 holds the clip in place, whilst allowing the side post insulator 570' to be removed from the assembly. Thus, this embodiment of the present invention allows the clip to be positioned in an "insulator-change" position, in which the side post insulator can be removed without the need for removal of the clip from the assembly or the removal of the assembly from the railway installation.

We claim:

1. A railway rail anchoring device, for use with a railway rail-fastening clip which is approximately M-shaped in plan and has first and second leg portions and a rail-bearing portion, the device comprising:

a base member; and first and second clip-retaining members connected together by said base member such that the first clip-retaining member is spaced apart from the second clip-retaining member so as to define between said first and second clip-retaining members an opening for receiving the said rail-bearing portion of such a clip;

wherein each of the said first and second clip-retaining members defines a passageway for receiving one of the leg portions of such a clip, a boundary surface of at least one of the said passageways including, at a location intermediate respective ends of said passageway, first locating means for engagement, when the device is in use with such a clip, with a first region of the leg portion of the clip located in said passageway such that the clip can be held in a preassembly position in which the clip is retained by the device but the rail-bearing portion of the clip does not bear on a rail, second locating means also being provided on a boundary surface of at least one of the said passageways for engagement with a second region of the leg portion of the clip located in said passageway such that the clip can be held in a working position in which the rail-bearing portion of the clip bears on the rail, the first and second locating means being such that the clip cannot move out of said pre-assembly position towards a rail unless driven in a first direction and the clip cannot move out of said working position away from said rail unless driven in a second direction, opposite to said first direction, and the said first locating means being provided by an abutment surface protecting from the said boundary surface.

2. A device as claimed in claim 1, including, in the said opening defined between the said first and second clip-retaining members, third locating means for engagement with a locating region of a toe insulator of such a clip so that the clip can be held in a maintenance position in which the clip does not bear on the rail and the said first region of the leg portion of the clip does not engage with the said first locating means of the device.

3. A device as claimed in claim 1, wherein the said passageways are defined in respective faces of the said clip-retaining members opposite to faces of the clip-retaining members adjacent to the said opening.

4. A device as claimed in claim 3, wherein the said passageways are in the form of a channel.

5. A device as claimed in claim 4, wherein longitudinal axes of the passageways are substantially parallel to a main surface of a rail foundation when the anchoring device is in use.

6. A device as claimed in claim 4, wherein the first and second passageways include an upper boundary surface which slopes downwardly in a direction away from the opening of the passageways into which a leg portion of the clip is inserted when the device is in use, the upper boundary surfaces abutting respective leg portions of the clip when the clip is being driven into the device so as to drive the leg portions downwardly with respect to the rail-bearing portion of the clip.

7. A device as claimed in claim 1, wherein the said second locating means are provided by a corner portion of the said boundary surface.

8. A rail fastening assembly comprising a railway rail fastening clip suitable for holding down a railway rail, and an anchoring device, the clip being formed of a rod of material bent such that the clip is approximately M-shaped in plan, having first and second leg portions formed to cooperate with part of the anchoring device so as to locate the clip in the anchoring device, and also having a rail-bearing portion formed between the first and second leg portions, the anchoring device comprising:

a base member; and first and second clip-retaining members connected together by said base member such that the first clip-retaining member is spaced apart from the second clip-retaining member so as to define between said first and second clip-retaining members an opening for receiving the said rail-bearing portion of such a clip;

wherein each of the said first and second clip-retaining members defines a passageway for receiving one of the leg portions of such a clip, a boundary surface of at least one of the said passageways including, at a location intermediate respective ends of said passageway, first locating means for engagement with a first region of the leg portion of the clip located in said passageway such that the clip can be held in a preassembly position in which the clip is retained by the device but the rail-bearing portion of the clip does not bear on a rail, second locating means also being provided on a boundary surface of at least one of the said passageways for engagement with a second region of the leg portion of the clip located in said passageway such that the clip can be held in a working position in which the rail-bearing portion of the clip bears on the rail, the first and second locating means being such that the clip cannot move out of said pre-assembly position towards a rail unless driven in a first direction and the clip cannot move out of said working position away from said rail unless driven in a second direction, opposite to said first direction, and the said first locating means being provided by an abutment surface projecting from the said boundary surface.

9. The device as claimed in claim 2, wherein the said passageways are defined in respective faces of the said clip-retaining members opposite to faces of the clip-retaining members adjacent to the said opening.

10. The rail fastening assembly of claim 8, including, in the said opening defined between the said first and second clip retaining members, third locating means for engagement for a locating region of a toe insulator of such a clip so that the clip can be held in a maintenance position in which the clip does not bear on the rail and the said first region of the leg portion of the clip does not engage with said first locating means of the device.

11. The rail fastening assembly of claim 8, wherein the said passageways are defined in respective faces of the said clip-retaining members opposite to faces of the clip-retaining members adjacent to the said opening.

12. The rail fastening assembly of claim 11, wherein the said passageways are in the form of a channel.

13. The rail fastening assembly of claim 12, wherein longitudinal axes of the passageways are substantially parallel to a main surface of a rail foundation when the anchoring device is in use.

14. The rail fastening assembly of claim 13, wherein the first and second passageways include an upper boundary surface which slopes downwardly in a direction away from the opening of the passageways into which a leg portion of the clip is inserted when the device is in use, the upper boundary surfaces abutting respective leg portions of the clip or when the clip is being driven into the device so as to drive the leg portions downwardly with respect to the rail-bearing portion of the clip.

15. The rail fastening assembly of claim 8, wherein the said second locating means are provided by a corner portion of the said boundary surface.

16. The rail fastening assembly of claim 8, wherein the M-shaped clip comprises a clip locating means on said first and said second leg portions formed to cooperate with the anchoring device.

17. The rail fastening assembly of claim 16, wherein the clip locating means on said first and second leg portions comprise detents.

* * * * *